US006663100B2

(12) United States Patent
Crowley

(10) Patent No.: US 6,663,100 B2
(45) Date of Patent: Dec. 16, 2003

(54) SYSTEM AND METHOD FOR SUPPLYING STACKED MATERIAL TO A UTILIZATION DEVICE

(75) Inventor: H. W. Crowley, 7 Osprey Cove, Eliot, ME (US) 03903

(73) Assignee: H. W. Crowley, Eliot, ME (US)

( * ) Notice: Subject to any disclaimer, the term of this patent is extended or adjusted under 35 U.S.C. 154(b) by 97 days.

(21) Appl. No.: 09/957,585

(22) Filed: Sep. 20, 2001

(65) Prior Publication Data

US 2002/0033570 A1 Mar. 21, 2002

Related U.S. Application Data

(60) Provisional application No. 60/234,155, filed on Sep. 21, 2000.

(51) Int. Cl.[7] ..... B65H 1/04

(52) U.S. Cl. ..... 271/165; 271/157; 221/197; 206/499

(58) Field of Search ..... 271/165, 157; 221/196, 197, 287; 206/449

(56) References Cited

U.S. PATENT DOCUMENTS

| | | | | | |
|---|---|---|---|---|---|
| 2,325,455 | A | | 7/1943 | Williams | |
| 3,787,188 | A | * | 1/1974 | Lyon | 422/198 |
| 4,770,301 | A | * | 9/1988 | Nagel | 206/556 |
| 4,802,586 | A | * | 2/1989 | George | 206/556 |
| 4,830,186 | A | * | 5/1989 | George et al. | 206/449 |
| 4,921,388 | A | * | 5/1990 | Nelson | 414/412 |
| 5,150,560 | A | | 9/1992 | Crowley | |
| 5,282,350 | A | | 2/1994 | Crowley | |
| 5,478,185 | A | | 12/1995 | Kranz | |
| 5,626,001 | A | | 5/1997 | Belec | |
| 5,779,049 | A | * | 7/1998 | Werby et al. | 206/451 |
| 5,871,102 | A | * | 2/1999 | Lambert | 206/738 |
| 6,029,425 | A | * | 2/2000 | Dunn | 53/449 |
| 2002/0153272 | A1 | * | 10/2002 | Rapoza | 206/449 |

OTHER PUBLICATIONS

Bell & Howell, 1975, Phillipsburg Expediter Imperial 10,000 Reference Guide, all pages.

* cited by examiner

*Primary Examiner*—Donald P. Walsh
*Assistant Examiner*—Kenneth W Bower
(74) *Attorney, Agent, or Firm*—Cesari and McKenna, LLP; William A. Loginov

(57) ABSTRACT

A system and method for storing and dispensing a stack of materials to a feed station of the utilization device that is adapted to feed stacks of the materials is provided. The materials, typically sheets or envelopes, are provided in a predetermined orientation in a stack in a container having a dispensing end or other opening. To dispense, the container is positioned with respect to the feed station and a release on the container is operated using a predetermined motion. The release enables the contents of the container, in stack form, to be transferred to the feed station free of any operator intervention with the contents of the stack. The dispensing end/opening can be shoulders on a container that are moved out of interfering contact with the stack when the stack is placed over upright guides on the feed station.

19 Claims, 14 Drawing Sheets

SYSTEM AND METHOD FOR SUPPLYING STACKED MATERIAL TO A UTILIZATION DEVICE

CROSS-REFERENCE TO RELATED APPLICATION

The present application claims benefit of U.S. Provisional Patent Application Ser. No. 60/234,155, which was filed on Sep. 21, 2000, by H. W. Crowley entitled MATERIAL SUPPLYING METHOD AND SYSTEM, and is hereby incorporated by reference.

BACKGROUND OF THE INVENTION

1. Field of the Invention

This invention relates to devices that feed envelopes and other sheet-like material from stacks.

2. Background Information

Current estimates place the number of envelopes used annually in the United States at over 100 billion. A significant percentage of these envelopes are used in connection with bulk mailings, and are accordingly filled, addressed and processed by a variety of automated machines. A lynchpin of all automated processes is the automatic envelope inserter. Automatic inserters are large, complex machines that are loaded with contents to be inserted (e.g., individual letter sheets and/or fillers) and envelopes in which these contents are to be inserted. Other machines such as binders, that bind inserts together (into a books, catalogs, newspapers or magazines), presses that apply logos and decoration, addressing machines, and a variety of other machines are also used selectively to process individual sheet-like materials in bulk mailing and other processes. These various devices can be termed generally "utilization devices" as they utilize sheet-like materials that are typically dispensed in stacks.

FIG. 1 shows a high-volume envelope inserter used by industry. The exemplary inserter 100 is a large, modular unit that combines various contents stored in hoppers (not shown) in the rear 102 of the machine and that directs the contents (arrows 104 and 106) onto a raceway 108 downstream (arrow 110) toward a stack of envelopes 112. At each point along the raceway, additional insert sheets are added to the contents. These contents may be folded, or otherwise compacted, to fit within the selected envelope by mechanism within the inserter. Envelopes are drawn from the stack 112, and directed downstream (arrow 114) to a inserting station 116 at which the closed-but-unsealed envelope flaps 118 are opened so that the final contents 120 (shown in phantom for clarity) can be inserted thereinto. The filled envelopes 112 are then transferred further downstream (arrow 124) to a stacking position or further-processing module (not shown).

Industrial inserters are available from a variety of well-known companies including Bell & Howell and Pitney Bowes. One example is the Bell & Howell Imperial™. With reference to the envelope stack 112, the stacking location or "feed station" 130 consists of a series of upright guide rails 132, 134 that, respectively, contain the four opposing sides of each envelope in the stack. In most commercially available machines, the envelope stack, as well as the hoppers (not shown) for the insert contents, are open at the top and exposed for easy access. This is, in part, because inserters typically consume envelopes in the range of 3000–25000 pieces per hour. Conversely, the contents hopper and envelope feed station only have capacity for a stack of approximately 300–400 pieces. As such, the various stations of the inserted must be constantly monitored and reloaded by one or more individual operators.

With further reference to FIG. 2, the cycle of feed station loading is more-clearly illustrated. A stack of a few hundred blank or pre-printed envelopes 142 is removed from a box 140 of one thousand. The box may be accessed through a top that exposes the envelopes on-edge as shown, or through another opening. In any case, a grouping 150 is lifted manually from the box 140, often bounced one or more times against a flat surface in an attempt to ensure registration, and then deposited (arrow 152) to the feed station 130 onto the stack 112. The envelopes are then drawn out of the stack 112 one at a time using any one of a number of singulating feed techniques. In the exemplary feed station, friction feed rollers 156, 158 and 160 operate in conjunction with a non-rotating gate wheel 162 to singulate and feed envelopes downstream to the insertion location from the stack bottom. Pushers, vacuum belts and sliding tables are also used to singulate envelopes and/or contents according to alternate arrangements.

The above-described stack-loading technique, in which small discrete bundles are transferred from the box to the feed station, can give rise to may different (often recurring) failures. For example, repetitive loading of relatively small bundles of envelopes increases the possibility of a feed failure for a given envelope from the stack based upon the sudden application of significant force to the stack bottom as envelopes are dropped into the feed station. This is an ongoing concern as stacks are typically fed from their bottoms against the entire overlying weight/friction of the remaining stack. In addition, it is critical that envelopes be loaded in only one orientation every time. In other words, flaps must generally be placed face-up, and in a specific direction. Nevertheless, there are at least four different possible orientations in which rectangular envelopes can be loaded into the stack—of which three out of the four orientations are incorrect. Given the continuous and repetitive nature of the loading process, it is not uncommon for an operator to miss-load envelopes fairly regularly. Moreover, the stack orientation of envelopes required by the inserter may be geometrically reversed from that in which the envelopes are removed from the box. This means that the operator must often rotate, flip over, or otherwise reorient the envelopes each time they are loaded. Over a period of time, the repetitive lifting of a heavy stack of envelopes and constant reorienting of this time can fatigue the operator and cause progressive orthopedic injuries. In fact, the related motions involve slitting open a continuous progression of envelope boxes with sharp blades to remove the contents further exasterbates fatigue and possible injury. Finally, the simple monotony of constantly and repeatedly reloading of relatively small bundles of envelopes into an open hopper seems an unavoidable but equally undesirable byproduct of inserter operation.

Prior proposals for increasing the efficiency of envelope and contents stack-loading have included the feeding of envelopes or insert pieces from large bound rolls, such as described in U.S. Pat. No. 5,282,350 to Crowley. Alternatively, the feeding of envelopes from large, palletized balk cassettes has been suggested according to U.S. Pat. No. 5,478,185 to Krantz. However, while these techniques show promise, they require owners of inserting machines to make a large investment to retool the existing install base of machines, which may unacceptably increase production costs thereby straining fragile profit margins. In addition, these techniques may prevent the equipment from being easily returned to conventional bundle-feeding when needed (such as when a small custom job is desired).

Accordingly, it is an object of this invention to provide an system and method for providing a large stack of sheet-like materials, such as envelopes, to a utilization device that reduces the number of stack-loading cycles required by the operator and essentially eliminates direct operator contact with discrete bundles of the materials. This system and method should also reduce the amount of effort spent by an operator in preparing a material supply container (box of envelopes) for use, and should increase the stack capacity of existing utilization devices without requiring substantial refit or retooling or the devices' feeding components. This system and method should also preferably allow material supply containers to be easily reused with minimal repair or refit. The containers should be collapsible into easily stored and transported shapes.

SUMMARY OF THE INVENTION

This invention overcomes the disadvantages of the prior art by providing a system and method for storing and dispensing stacks of sheet-like materials using a container that encloses a large number of stacked, sheet-like materials (such as envelopes) having a common predetermined orientation within the container. The container is arranged with a release mechanism at a dispensing end or opening thereof, arranged so that when the container is mounted in an appropriate sequence on a stacking location/feed station on a utilization device, the container releases its stack into the feed station for use by the utilization device.

In an illustrative embodiment, the feed station can include guides that, in conjunction with the container, enable the container to extend and further guide the stack beyond the top ends of the guides. In this manner, the overall capacity of the utilization device feed station is increased. The feed station is preferably adapted so that it can be readily used in a conventional manner by manual loading of smaller, discrete bundles materials and/or stacks of materials without use of the container if desired.

According to one embodiment, the dispensing end or opening includes a set of folds adapted to fold inwardly toward the inside walls of the container when the container is directed over the guides. This enables the stack to drop onto the feed station guides. The outer dimensions of the container can be sized to allow the container to fit over the guides so that it comes to rest at the bottom of the feed station.

According to another embodiment, the container can comprise a box-like structure having a variety of operator-actuated release mechanisms that normally restrain the stack from passage out of the dispensing end or opening, but based upon a predetermined movement (generally once the dispensing end or opening confronts the opening of the feed station), the dispensing end or opening releases the stack into the feed station. The container may be adapted to define an extended guide for a deeper stack, and appropriate internal structures can be provided to the container to facilitate support and guiding of a deeper stack. In one embodiment the dispensing end or opening of the container includes an interlocking flap closure structure with a series of overlapping tab sections that positively retain the stack against outward movement, but that can be opened by applying a force in an opposing inward direction to unlock the interlocking flaps from each other.

In another embodiment, the container can define any number of non-fully enclosing structures that restrain the breakup of the storage stack until the release mechanism is activated. For example, the container can be a ribbon or wrap that is broken and withdrawn once the stack is deposited in the feed station. The container can be a comb-like structure that supports an edge of the stack, and is withdrawn after deposition in the feed station. Similarly, the container can be a plurality of interconnections between adjacent materials in the stack, that are typically adhesively joined, and broken free at a desired time. The container can also comprise an extended feed surface that may be removable, for causing a waterfall of materials into the feed station from the larger feed surface.

In yet another illustrative embodiment, a container in the form of an envelope-filled cassette is provided. The cassette is arranged with a dispensing end or opening that can be opened by the user or an alternate closure along some or all of the elongated length thereof so that all, or a substantial portion, of the envelope contents can be randomly accessed for manual feeding or other uses. The dispensing end or opening, in one embodiment can be opened by removing the bottom using a tear strip, embedded below the surface of the cassette, that causes the bottom to separate from the remainder of the dispensing cassette by pulling the tear strip away from the circumference of the box. A fixture is located on the stacking location/feed station and defines a receptor for the cassette. The receptor is adapted to support the cassette so that it is suspended out of interfering contact with the workings of the feed station, bridges and maintains continuity between any material previously located at the feed station and the start of feed from the newly mounted cassette, and generally allows visual inspection of the flow of envelopes from the feed station so as to enable change of the cassette at the appropriate time and overall observation of the rate of consumption. To accomplish this interconnection between the receptor and cassette, the receptor includes three or four sides in which opposing sides force the cassette into a proper (squared) orientation. The receptor can include a slanted wall and a straight wall, opposite thereto, in which the slanted wall urges envelopes entering (dropping into) the feed station from the cassette against the straight wall for proper justification of the entering envelopes. The receptor can include, on two opposing walls, sets of flexible guide strips that deflect away from the cassette in the area in which it occupies, but that straighten in an area below the bottom edge of the cassette so as to firmly hold the cassette in place and justify the envelopes along adjacent edges as they leave the cassette bottom. The guides can be adjustable for length and width using a variety of moving and locking mechanisms (for example, slides, thumb screws, etc.). Finally, the cassette can be constructed with a shoulder seam or other key that interacts with a corresponding structure in the receptor in a manner that allows the cassette and receptor to mate only in a desired orientation.

BRIEF DESCRIPTION OF THE DRAWINGS

The foregoing and other objects and advantages of the invention will become clearer with reference to the following detailed description as illustrated by the drawings in which.

DETAILED DESCRIPTION OF ILLUSTRATIVE EMBODIMENTS

Figure 1:
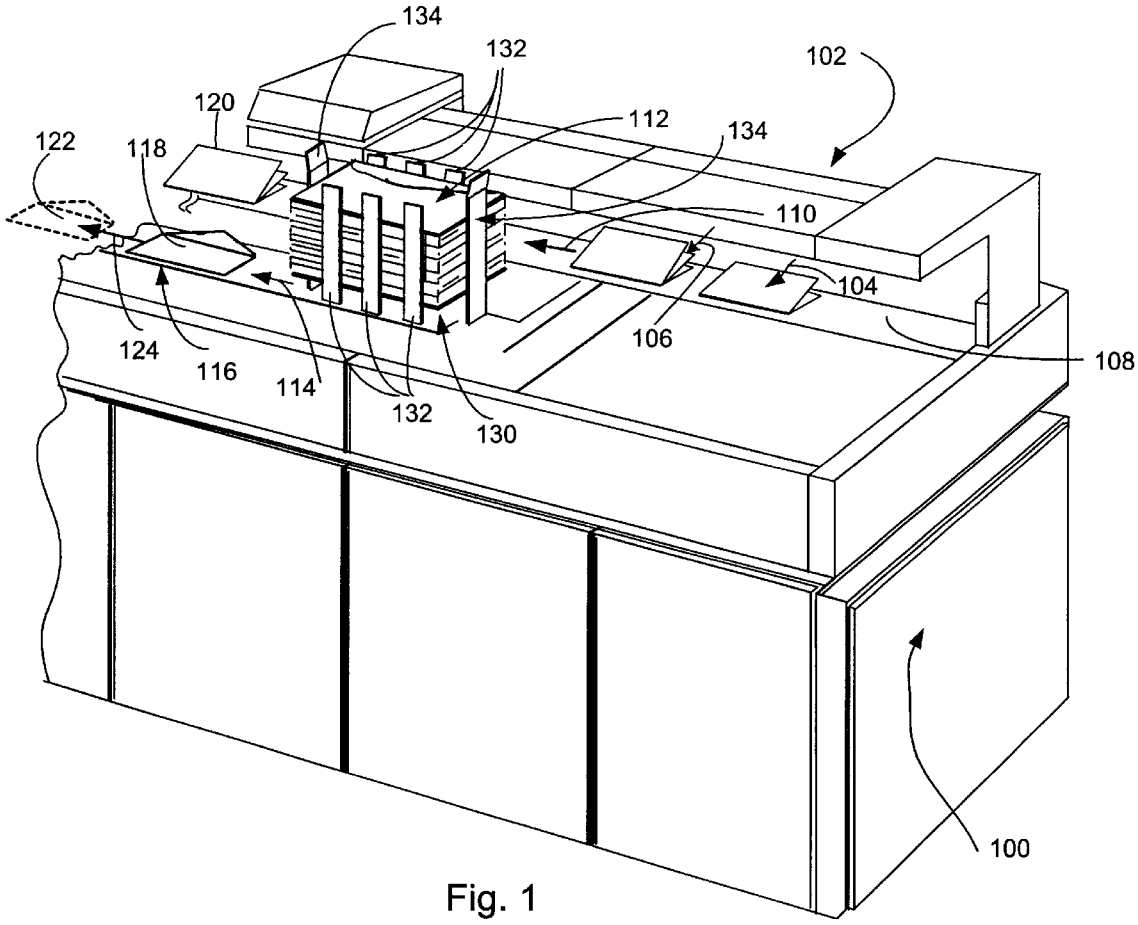
Fig. 1 (Prior Art)
FIG. 1, already described, is a somewhat schematic perspective view of a material utilization device in the form of an envelope inserter, according to the prior art.
Figure 2:
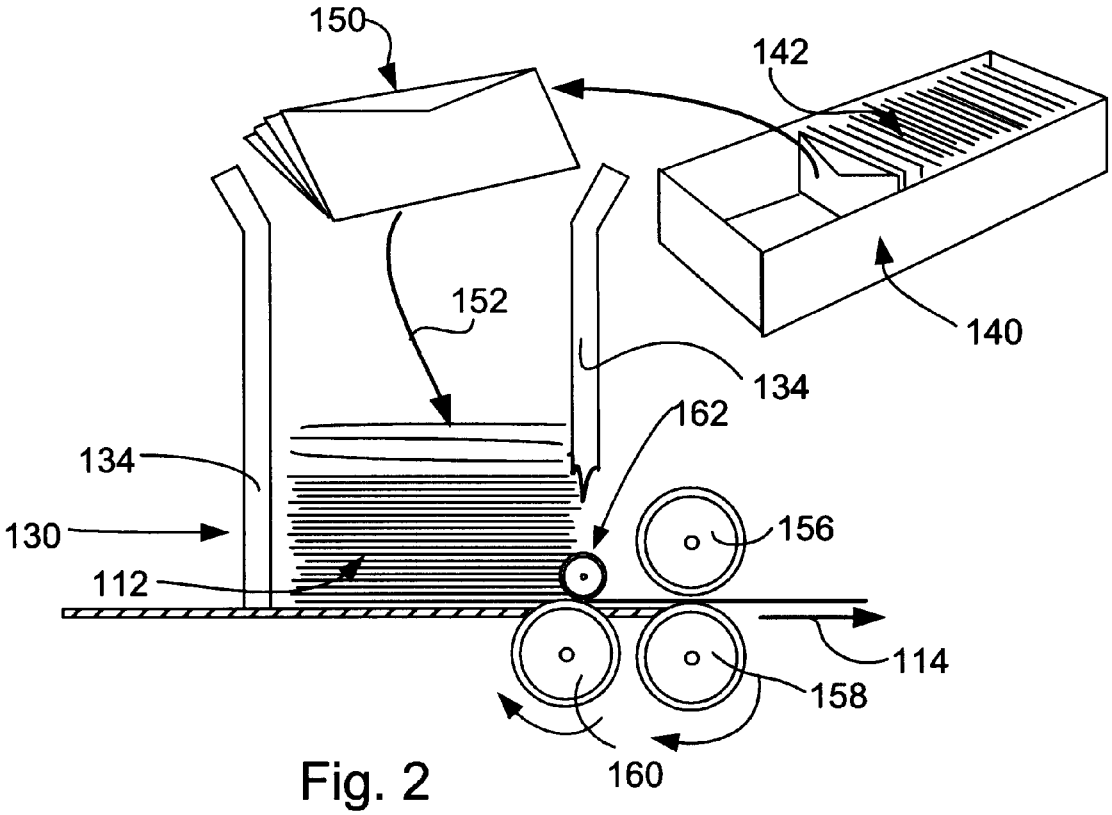
Fig. 2 (Prior Art)
FIG. 2, already described, is a schematic diagram of a conventional procedure for loading materials that comprise envelopes into the inserter of FIG. 1 according to the prior art.
Figure 3:
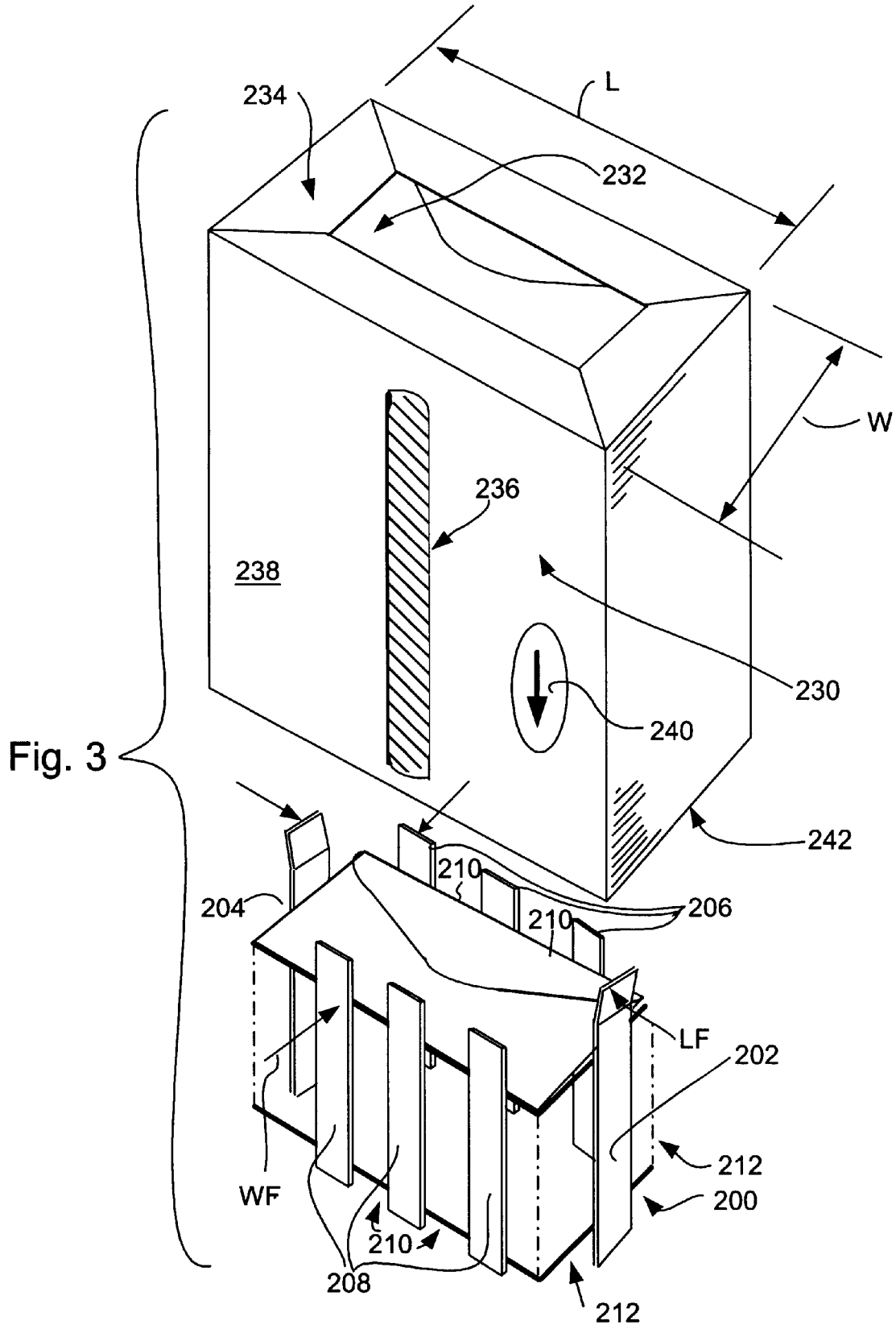
FIG. 3 is a perspective view of an envelope loading system and corresponding feed station on a utilization device for receiving the envelope loading system according to an embodiment of this invention.

FIG. 3 shows a generalized system for feeding of envelopes or other sheet-like materials in stacks according to an embodiment of this invention. A utilization device feed station 200 is provided. This feed station for the purposes of this example, is the envelope feed location for a conventional high volume inserter as described above. It is adapted to hold a stack of envelopes approximately 300–400 pieces high. The exact size and shape of the envelopes or other sheet materials described for the purpose of this embodiment. They can be rectangular, square or even non-rectangular shapes. All items in a stack are approximately the same size and shape for ease of dispensing and storage. The feed station 200 includes a set of upright guides 202, 204 206 and 208. The guide define narrow-width bars, typically formed from metal or another rigid material. In this example, side guides 202 and 204 are place along the exemplary narrow sides of the envelope while two sets of three guides 206, 208 along the opposing elongated sides of the envelopes. Spaces 210 are defined generally between the guides 206 and 208 and the corners are left open (212). The open nature of the guide allows the level and condition of the envelope stack to be easily viewed, jams to be cleared quickly and friction on the envelopes as they drop down the feed station, being withdrawn by the feeder mechanism, to be reduced. With reference to the feeder mechanism, any acceptable feed device for removing envelopes can be employed. The mechanism shown in FIG. 2 is one possible feed mechanism. However, it is expressly contemplated that feeding of envelopes from the bottom, or any point along the stack can be performed according to this invention.

Shown above the feed station 200 is an envelope storing and dispensing container 230 according to an embodiment of this invention. The container is sized with a width W and length L that is sufficient to enclose the perimeter of subject envelopes 232 stacked therein. The container includes a top section 234 that can be partially open/exposed (as shown—revealing a flap side of an exemplary envelope) or the top 234 can be fully covered. A groove 236 can be defined along the length of at least one side 238 of the container to show the level of envelopes within the container and their general condition. It is contemplated that all envelopes are placed in the same orientation (e.g., all flaps are located in the same direction along the side of the container). One or more indicia 240 can be provided on the container to assist an operator in understanding the orientation of the container contents.

As will now be described in detail, the container "dispensing end or opening" 242 is particularly adapted to enable envelopes to be easily transferred in bulk, from the container 230 into the feed station 200 without requiring individual subsets of envelopes to be handled or removed by an operator. In other words, this container and the others to be described herein enable direct transfer of envelopes and other sheet-materials in their entirety from the container into the stack feed location with little or no operator contact with the container content. In addition, where applicable, the container provides further guidance of envelopes or other sheet-materials while the container remains engaged with the feed station.

Figure 4:
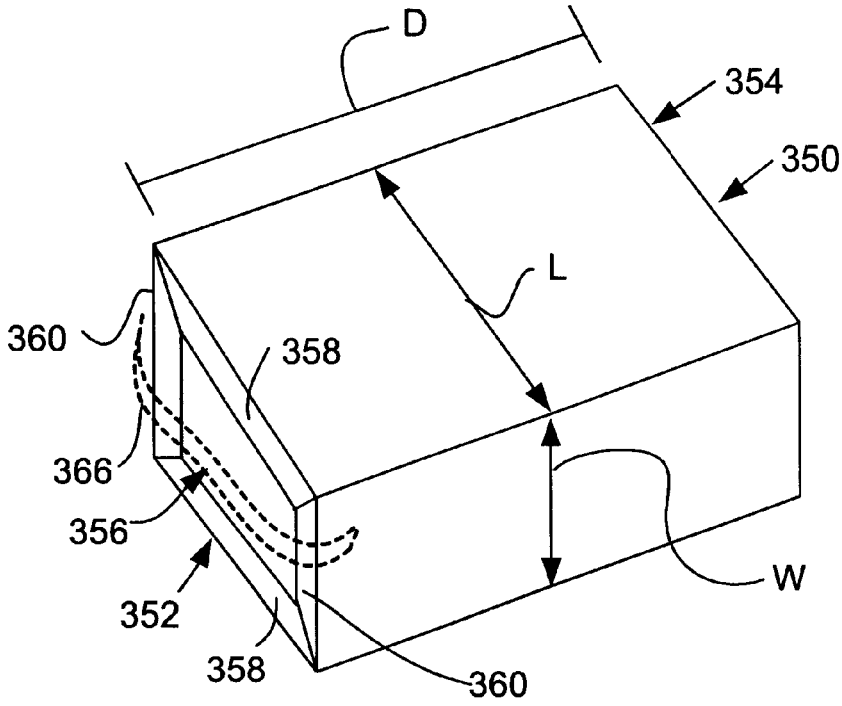
FIG. 4 is a perspective view of a container for storing and dispensing envelopes according to an embodiment of this invention.
Figure 5:
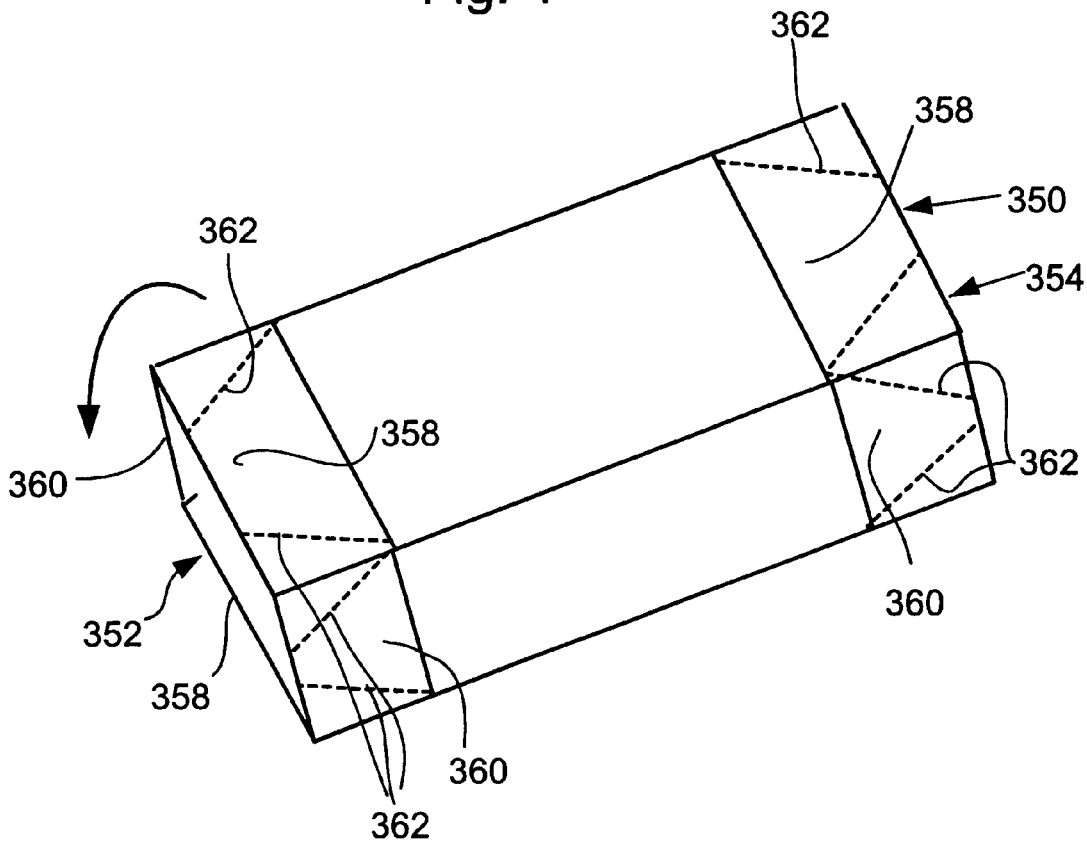
FIG. 5 is a perspective view of the container of FIG. 4 shown in an opened configuration.

FIGS. 4 and 5 show an exemplary dispensing and storage container 350, according to an embodiment of this invention, in more detail. The container in this embodiment can be formed from a durable plastic, card stock, corrugated cardboard or any other material appropriate for constructing containers designed to support the weight of 500–1000 envelopes or other sheet-like items during shipment and handling. The thickness of the container stock, as well as the kind of joints used to secure the container stock together (staples, adhesives, folds), are widely variable and depend in part upon the desired strength characteristics of the container.

The container 350 defines a width W and length L that are scaled generally to the perimeter size of the envelopes and a depth D that depends upon the total number of envelopes to be stacked within the container. The dispensing end or opening 352, and opposing closed end 354 of the container 350 are shown alternately in a closed an opened configuration in FIGS. 4 and 5, respectively. The ends 352 and 354 are defined from a series of folds in the corresponding sides that generate an open center 356. This closure structure retains the stored envelope stack against passage out of the container. In particular flaps or shoulders 358 and 360, that result from folds along the fold lines 362 (FIG. 5) generate the desired closure. An optional retaining strip 366 (shown in phantom) can be applied over one or both of the container ends 352 and 354 to prevent the flaps/shoulders 358 and 360 from releasing inadvertently during transport or handling. This tape can be quickly removed prior to use. Other temporary end reinforcing techniques such as adhesive spots on folds, removable pull tabs or other techniques for strengthening the ends can be employed, an end can remain relatively free to open so long as it is left upright so that the weight of the envelope stack within the container does not bear upon it. In addition, more advanced folding techniques (described below) can be employed that resist outward opening (yet enable ready dispensing) at the dispensing end or opening.

Figure 6:
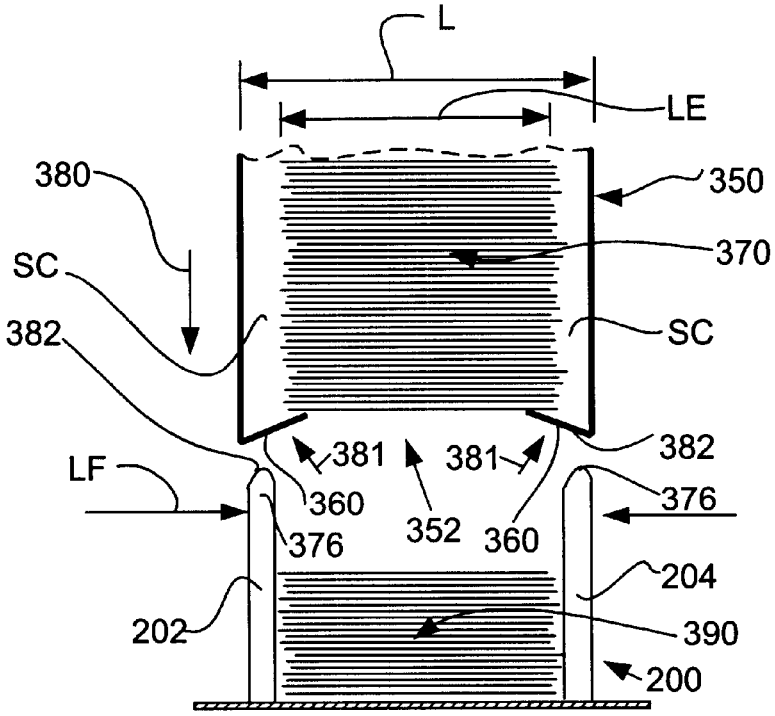
FIG. 6 is a schematic side view of a loading procedure for a container containing envelopes onto the feed station according to an embodiment of this invention.
Figure 7:
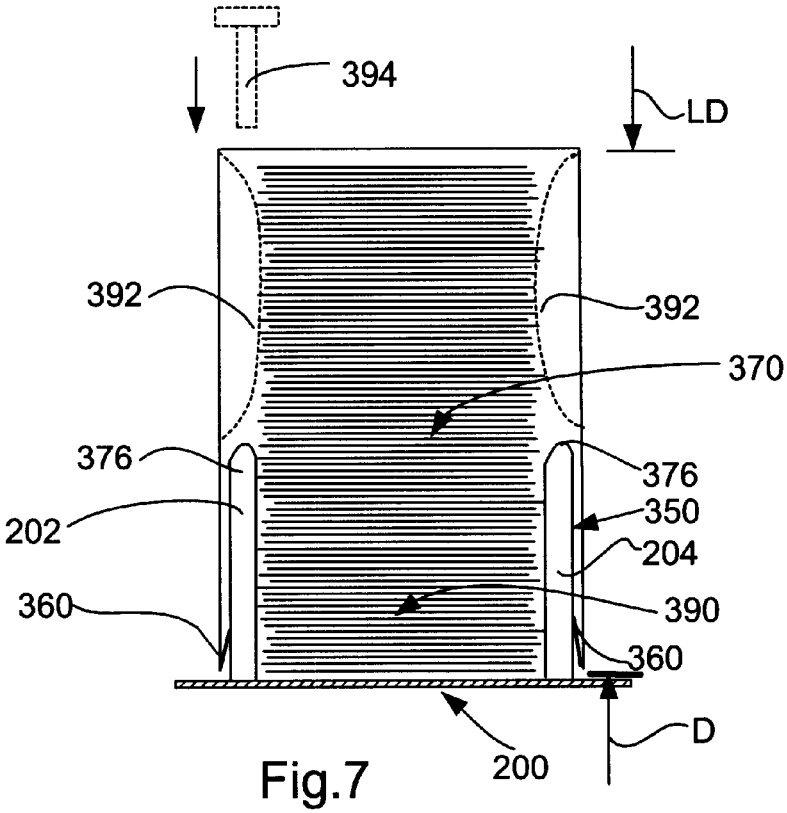
FIG. 7 is a schematic side view of the completed loading procedure according to FIG. 6.

Referring now to FIG. 6, use of the container in a feed station stack-loading process is described in detail. The container 350 contains a stored stack 370 of envelopes or other sheet-like materials to be dispensed. The dispensing end or opening 352 of the container 350 is brought over (or adjacent to) the feed station 200 so that sides of the container are aligned with the upright feed station end guides (202 and 204). The counter-posed sides of the container should, likewise, be aligned with the corresponding side guides 206 and 208 (not shown for clarity—refer to FIG. 3).

In this embodiment, the length L and width W of the container 350 should be at least slightly greater than length LF and width WF defined by the outer perimeter of the feed station guides 202, 204, 206 and 208. In addition, the top edges 376 of the guides 202 and 204 should be shaped to assist in directing the inner surfaces of the container over the outer surface of the guides. A downward pressure (arrow 380) is applied to the container 352 onto the guides. The top edges 376 of the guides force the container flaps/shoulders 360 (and corresponding opposing flaps/shoulders 358, not shown for clarity—refer to FIG. 4) to pivot upwardly (arrows 381) about their respective folds 382.

The length LE of the envelopes in the stack is less than the average length L of the container. Likewise the length of the envelope stack is less than the width W of the container. In this manner, an open space SC is created between the envelope stack and the container walls. The open space SC, combined with the inherent compressibility of the envelopes, enables the container closure flaps/shoulders 360 (and counter-posed flaps/shoulders 358) to fold fully against the inner walls of the container sides.

As the forcible directing of the container down onto the guides 202 and 204 continues, the stored stack 370 is released onto the feed station 200 to join the preexisting stack 390 (if any) in the feed station. The open space SC provides clearance for the guides to nest when the container is passed fully thereover. Note that the shoulders 360 are folded up between the inner walls of the container and the outer surfaces of the guides. The top edges 376 of the guides should be shaped (typically with a funnel-like profile) so as to urge the stack into the guides free of any binding of envelopes at the top of the guides.

Since the overall depth D of the container is greater than the length of the guides, it enables the container to act as a supplemental guide unit, thereby enabling additional envelopes or other sheet-materials to be fed to the feed station 200. While it is contemplated that sheet-to-sheet friction can generally maintain the stack in appropriate alignment, additional inner guides 392 (shown in phantom) can be deployed within the container. These guides can comprise perforated strips that are folded-in to fill the distance SC in the upper portion of the container or another acceptable structure. They can also comprise external guide bars that are placed through holes in the top of the container such as the exemplary bar 394 (shown in phantom). Such bars are removed prior to removal of the container 350, once a certain level of the stack therein has been exhausted by the feeding process.

A variety of other deployable structures can be provided to the container so as to selectively project into the enclosure of the container to contact the envelopes. One such possible structure is a deployable shoulder that provides drag on envelopes at predetermined locations along the depth D. This can serve to prevent the extended feed stack within the container from bearing to heavily on the bottom of the stack until a predetermined number of envelopes below the deployable structure have been exhausted. Such shoulders operate by hanging-up a side of the envelope requiring it, and overlying envelopes to become angled sufficiently downwardly before they drop toward the bottom of the stack. The envelopes only become sufficiently angled when the opposing side is lowered sufficiently as a result of the feeding away of the lower portion of the stack-until it is safe top deposit additional weight onto the lower portion.

Additionally, spacers (not shown) can be provided to limit the final resting position of the dispensing end or opening of the container with respect to the feed station surface. In other words the distance that the container can move downward onto the guides can be limited. This serves to prevent the dispensing end or opening from interfering with passage of sheets out of the bottom of the stack or interference with any part of the feed station's singulating/advance mechanism. Spacers can be attached to the guides, placed at non-interfering locations on the feed station perimeter surface, or formed onto the dispensing ends/openings as pullout tabs, for example.

Note that a particular advantage of the above-described arrangement is that the feed station can be used in a conventional manner without the use of the container according to this invention. In other words, manual feed of batches of envelopes can still be accomplished when container-feeding is not desired or is not available.

Figure 8:
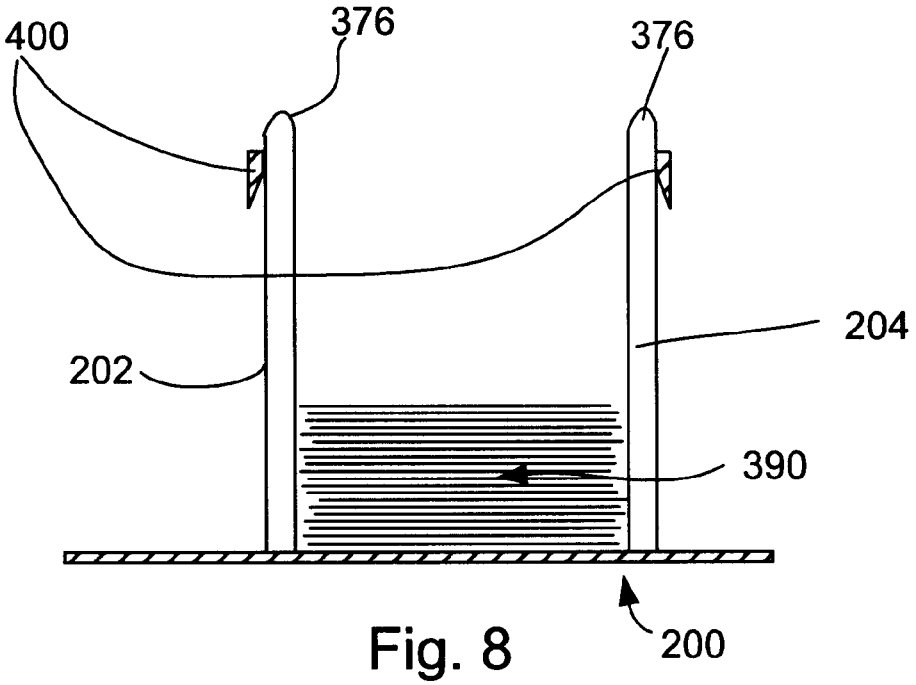
FIG. 8 is a schematic side view of a modified feed station for use with containers of this invention.
Figure 9:
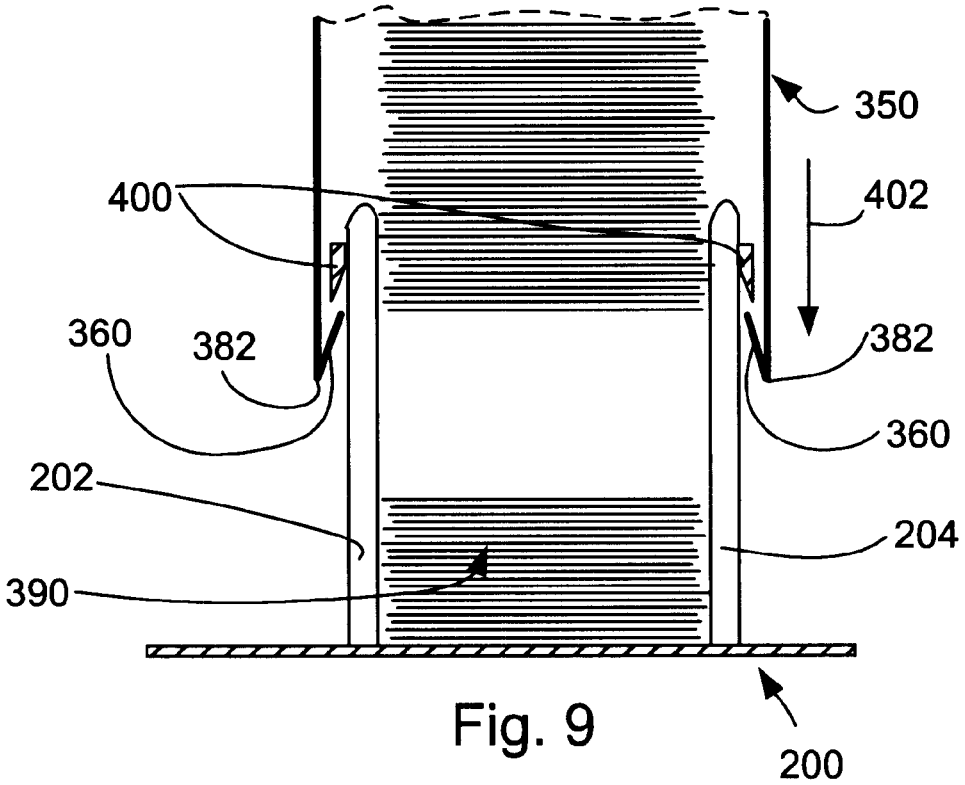
FIG. 9 is a schematic side view of a container in engagement with the modified feed station of FIG. 8.

FIG. 8 shows further modified guides 202 and 204 including hook members 400. As shown further in FIG. 9, placement of the container 350 over the guides 202, 204 causes folding of the flaps/shoulders 360 as described above. The folded flaps/shoulders 360 are then captured by the undercut lower ends of the hooks 400 so that upward movement (withdrawal) of the container out of contact with the guides 202 and 204 is resisted. This can be used to provide a safety mechanism to prevent containers to be removed prematurely. Alternatively, where containers are sufficiently flexible the hooks 400 can be used to force the shoulders open as the container is removed. This is accomplished because the hooks cause the shoulders to pivot outwardly along their folds 382 as force is applied in an upward direction.

Figure 10:
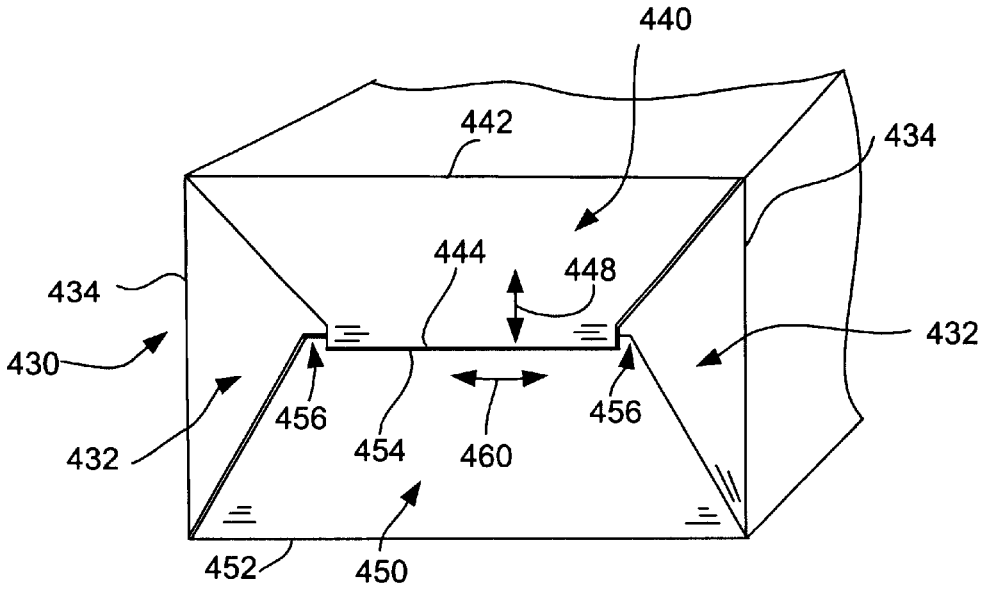
FIG. 10 is a perspective view of a folded container end adapted to release envelopes into the feed station shown in a closed state.
Figure 11:
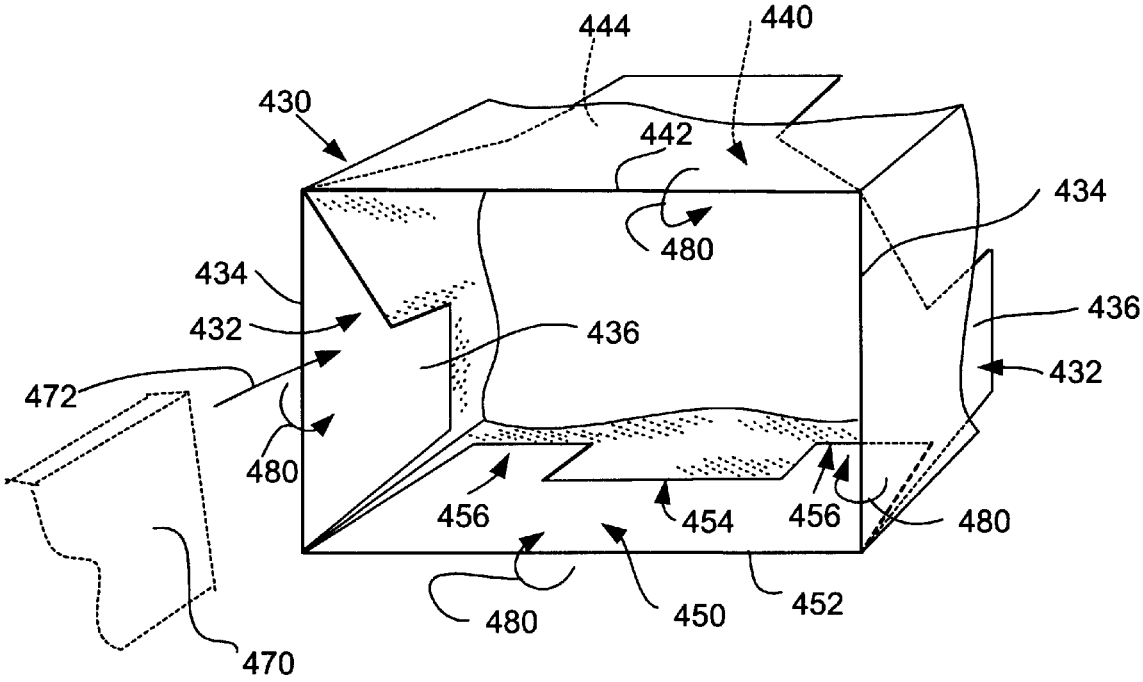
FIG. 11 is a perspective view of a container end of FIG. 10 shown in an open state.

FIGS. 10 and 11 show an embodiment of a container dispensing end or opening 430 having a flap/fold structure that particularly resist outward opening, but that are capable of being forced inwardly to dispense its materials, in the manner described generally above, when the container end 430 is directed into contact with appropriately shaped guides. The end 430 consists of four discrete flap closure sections. Two side flaps 432 are joined to the corresponding side corners 434. These flaps are angled downwardly to tabs 436. A somewhat trapezoidal upper flap 440 is joined to the upper corner 442. It is angled toward a centralized tab 444 that extends beyond the midpoint along the widthwise direction (double arrow 448). Note, "upper" is used only for the purposes of this illustration. An opposing, somewhat rectangular lower flap 450 is joined to the lower corner 452. It defines a notch 454 between two end tabs 456 that each extend beyond the midpoint in the widthwise direction. The length of the notch in the lengthwise direction (double arrow 460) is slightly longer than the upper flap tab 144.

The flaps 432, 440 and 450 form an interlocking closure (FIG. 10) in which and extended portion of each half (tabs 436, 444 and 456) underlie an inner-facing portion of an adjacent flap. This positively prevents outward opening of the closure.

Conversely, when upright guides 470 (shown in phantom) are directed (arrow 472) against the flaps, the fold inwardly about their respective corners as denoted by the curved arrows 480 with little resistance from the closure structure. The inner perimeter dimensions of the container, and the compressibility of the stack can enable guides to enter the container, and the flaps to fold up into a space between the edge of the stack and the inner container walls (as described generally above).

Note that, following a movement inwardly to collapse the interlocking flap structure, a subsequent outward/withdrawal movement may allow the flap members to become opened outwardly, thereby enabling the materials to be dropped from the container into the feed station without fully engaging the container onto the feed station.

The particular size and shape of the flaps and folds for the container end 430 can be varied based upon the characteristics desired. By reducing the area between interengaging members of the flaps, the flaps may be easier to open, but may also exhibit weaker materials-retention characteristics when closed (FIG. 10). The best shape for flaps can be determined by trial and error, feeding actual stacks into the feed station using containers differing flap dimensions, until a desired balance of strength to ease of opening is achieved. As used herein the term "interlocking flap closures" can be used to describe a flap and fold structure that includes overlapping, interlocking pieces that hold together in one direction to positively retain the materials in the container, but that can be unlocked by applying a release force in a second direction.

Figure 12:
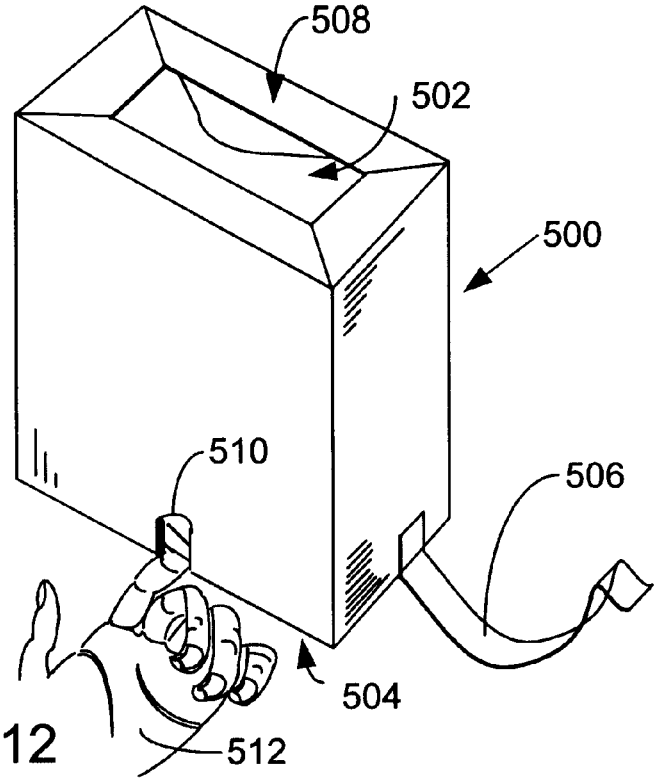
FIG. 12 is a perspective view of a container for dispensing envelopes according to an alternate embodiment.

FIG. 12 shows a more basic release mechanism for a container 500 used for storing and dispensing a full stored stack of envelopes, or other sheet-like materials, to a feed station according to an embodiment of this invention. The container 500 can include a stack 502 of envelopes or other sheet-materials that is dispensed through its downwardly facing dispensing end or opening 504 after first removing an optional adhesively attached securing strip 506 or other retaining device and then allowing the envelope stack 502 to drop, shingle or waterfall into the feed station. This strip can be substituted for an alternative storage/shipping lid or cover. In another embodiment, the lid/cover can be omitted entirely, and the container can be simply stored with the open dispensing end or opening facing upwardly. A slot 510 can be provided for one or more fingers of an operator's hand 512 to holds the envelope stack in place as the container is turned over into a dispensing position—in which the stack drops by gravity into the guides of the feed station. The bottom is otherwise open and free of any obstructions to the flow of envelopes there through, requiring the finger to retain envelopes until final dispensing can be accomplished. The size of the container can be closely conformed to that of the envelope stacked perimeter, or it can be large enough to pass over the outer edges of the guides (in which case, the container can also act as a supplemental extension stack guide as described above). Note that the opposing closed end 508 of the container 500 is typically enclosed sufficiently to prevent escape of the envelope stack therefrom. This enables the container to be securely held in an inverted orientation, with the envelope stack supported against the closed end 508 under gravity, until final dispensing is accomplished by turning over the container to present the dispensing end or opening 504 to the feed station.

The basic embodiment of FIG. 12 clearly illustrates a salient concept of the invention. That is, that a container or other device for collecting an entire stack of envelopes or sheet-materials can be provided that enables bulk transfer of container's contents to an appropriate feed station without substantial operator intervention in the transfer of discrete subsets of the overall container contents.

Figure 13:
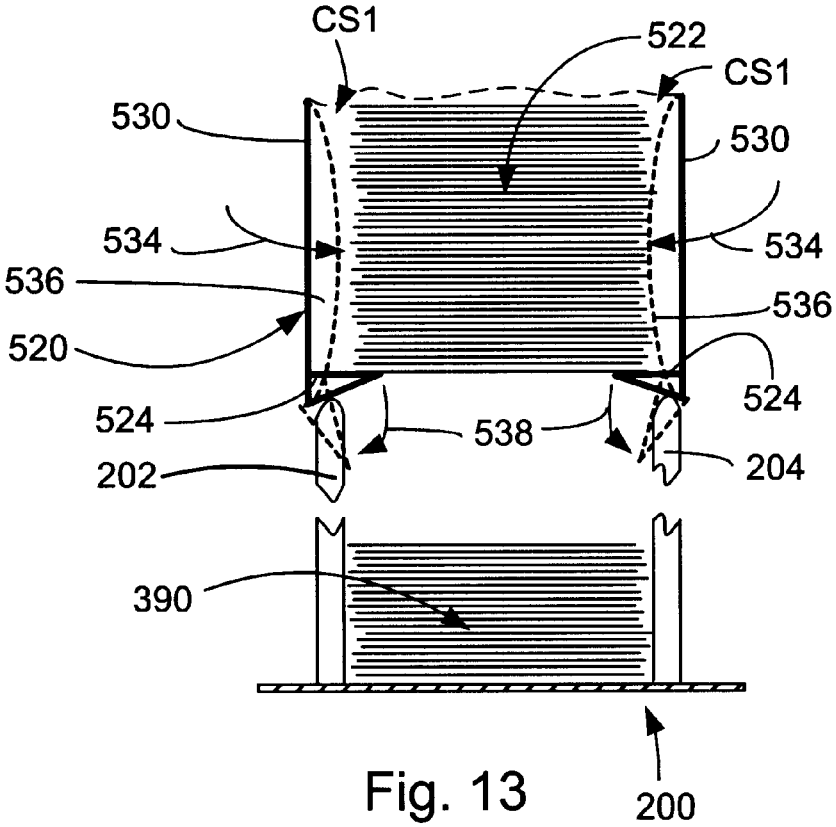
FIG. 13 is a schematic side view of a container for dispensing envelopes according to another alternate embodiment of this invention.

FIG. 13 details an alternate embodiment of the invention in which the container 520 includes an active release mechanism. The internal stack 522 of the container is normally blocked by triangular shoulders 524 formed on at least two of the four container sides. These shoulders can be constructed by joining separate pieces together, or preferably, by folding and joining extensions of the container side walls. The shoulders act as a triangular truss support that normally serves to provide substantial resistance to passage of the stack 522 therethrough in a closed orientation. A clearance space CS1 is defined between the edges of the stack 522 and the outer sides 530 of the container. This space is sufficient to enable passage of the sides 530 over the sides 202 and 204 of the feed station 200. The container can be adapted to be passed fully over the guides, or can be used simply to transfer stack onto the feed station without acting as a supplemental guide. Where the container is adapted to be passed over the guide, the stops 524 can be segmented so that they are located only between the guides, and for example, the corner spaces (see FIG. 3).

In a dispensing operation, the container 520 is first presented to the feed station guides 202, 204. Then, selected portions 536 of the container sides 530 can be depressed (arrows 534) inwardly as shown in phantom, into a clearance space CS1 by inwardly pressing the selected portions 536, a bending moment (curved arrows 538) is generated adjacent the supports 524, thereby allowing the stack 522 to pass through the bottom of the container and into the feed station 200.

Figure 14:
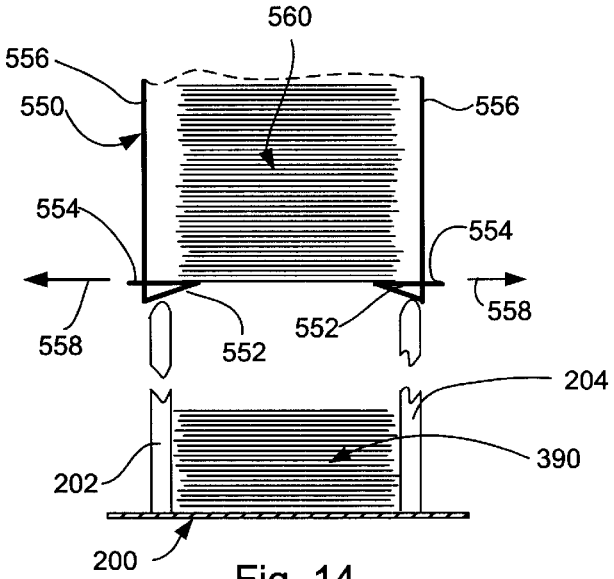
FIGS. 14–17 are each schematic side views of containers for dispensing envelopes according to various alternate embodiments.

FIG. 14 illustrates anther embodiment for a container 550 having a release mechanism in which triangular supports 552 enclose the dispensing end or opening of the container 550. Tabs 554 extend outwardly from the container sides 556 when the container is located over the feed station 200, the tabs 554 are moved outwardly (arrows 558), causing the tabs 552 to withdraw sufficiently for the stack 560 to pass into the feed station 200.

Figure 15:
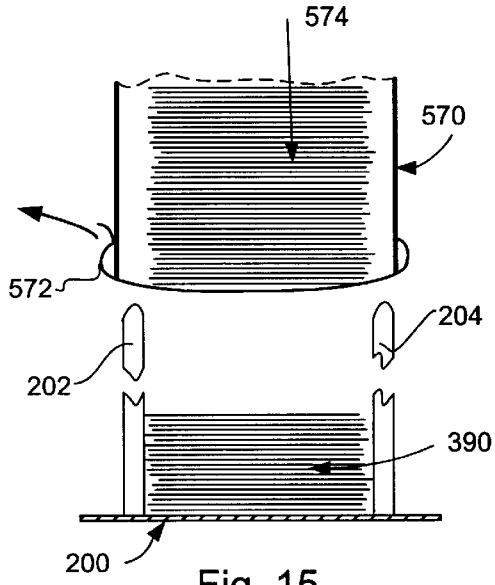

FIG. 15 shows an embodiment of the container 570 in which the dispensing end or opening is enclosed by a tab or other flexible securing mechanism 572. By removing the tab or other mechanism, the stack 574 passes into the feed station. The container can be passed over the guides 202 and 204 once the tab 572 is removed. Alternatively, the tab 572 can be segmented so that it passes between the guides 202, 204 allowing the container to be passed mostly onto the feed station before the tab assembly requires removal.

Figure 16:
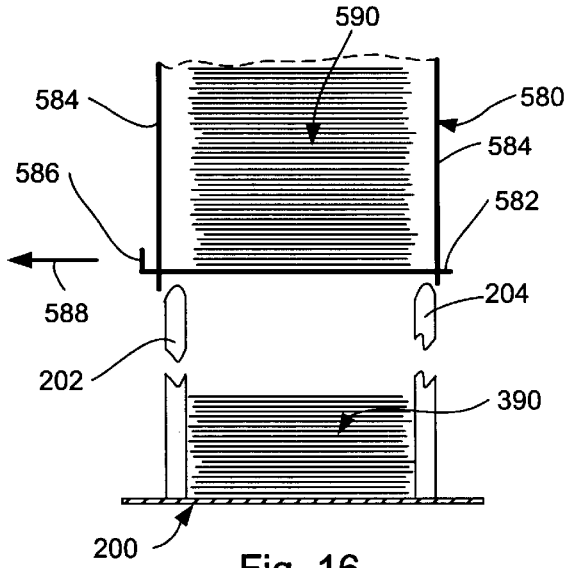

FIG. 16 shows another embodiment for a container 580 in which the dispensing end or opening is enclosed by a rigid plate member 582. This member can be constructed from the same material as the remaining container (e.g. card stock, etc.). The member 582 is secured through the lower ends of the side walls 584 via slots or other structures defined on the container side walls. The member 582 can include a folded exterior tab or other handle 586 for gripping. When the member 582 is slid (arrow 588) out from under the dispensing end or opening, the stack 590 is released into the feed station 200. Again, this container 580 can be adapted for mounting over the guides 202 and 204.

Figure 17:
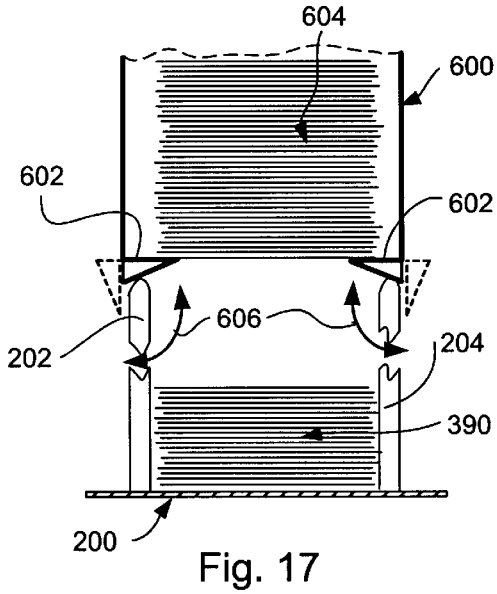

FIG. 17 shows yet another embodiment of a container 600 in which a pair of folding triangular cross-section closures 602 (e.g. triangular truss/bracket shapes) are formed by folds in the side wall ends of the container. The closures support at least two opposing sides of the stack 604. The closures can be pivoted (curved arrows 606) to the outwardly opened positions shown in phantom in the manner of bomb bay doors. This enables the stack 604 to be released onto the feed station, and the container to be slid over the guides if desired. The closures can be adapted to act as spacers to suspend the box end above and remote from the feed station feeder components/pathway as described generally above. This spacer function can also be accomplished by the container shown and described according to FIG. 13.

Figure 18:
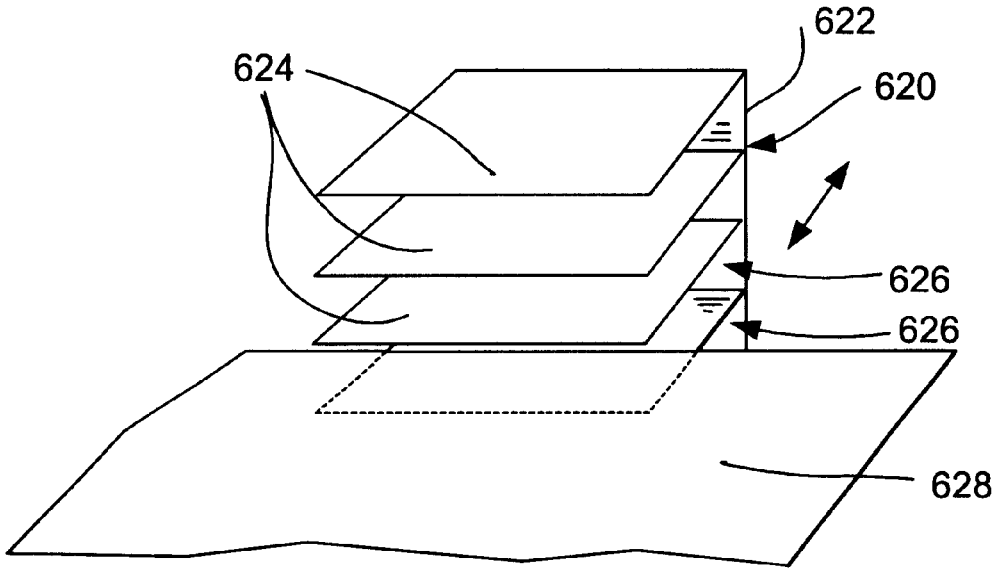
FIG. 18 is a schematic perspective view of a framework for storing and dispensing envelopes according to an embodiment of this invention.
Figure 19:
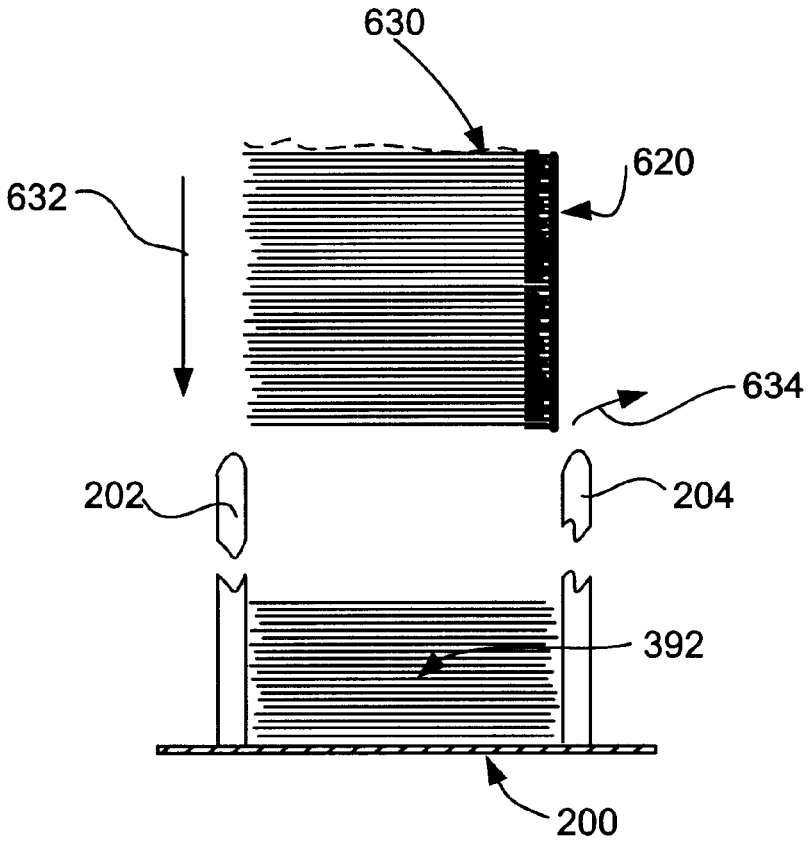
FIG. 19 is a schematic side view of the framework of FIG. 18 to dispense envelopes to utilization device feed station.

Each of the preceding embodiments has described a container that defines a substantially fully enclosing box on at least four contiguous sides. FIGS. 18 and 19 illustrate an embodiment in which sheets are restrained by a non-enclosing structure that, nevertheless, selectively enables storage and transport of materials in a stack at first time, followed by dispensing of the materials into the feed station at a second time.

As shown in FIG. 18, a comb-like frame 620 defines a form of container/containment structure for storing and selectively dispensing envelopes according to an embodiment of this invention. The container structure 620 defines a spine 622 and a series of comb-like, flat projections 624. Within the space 626 between each projection are located individual envelopes 628 and other sheet-like materials. The space 626 between projections 624 can be relatively small, assisting in holding the sheets therein by force or friction. The container structure 620 can be located so that it is disposed between selected guides to be removed after a stack is placed within the feed station 200.

As shown in FIG. 19, the stack 630 when supported by the comb-like container structure 620 is lowered (arrow 632) into the feed, and the comb is removed (arrow 634). This enables the individual envelopes in the stack to lay atop each other free of intervention from the comb projections.

Figure 20:
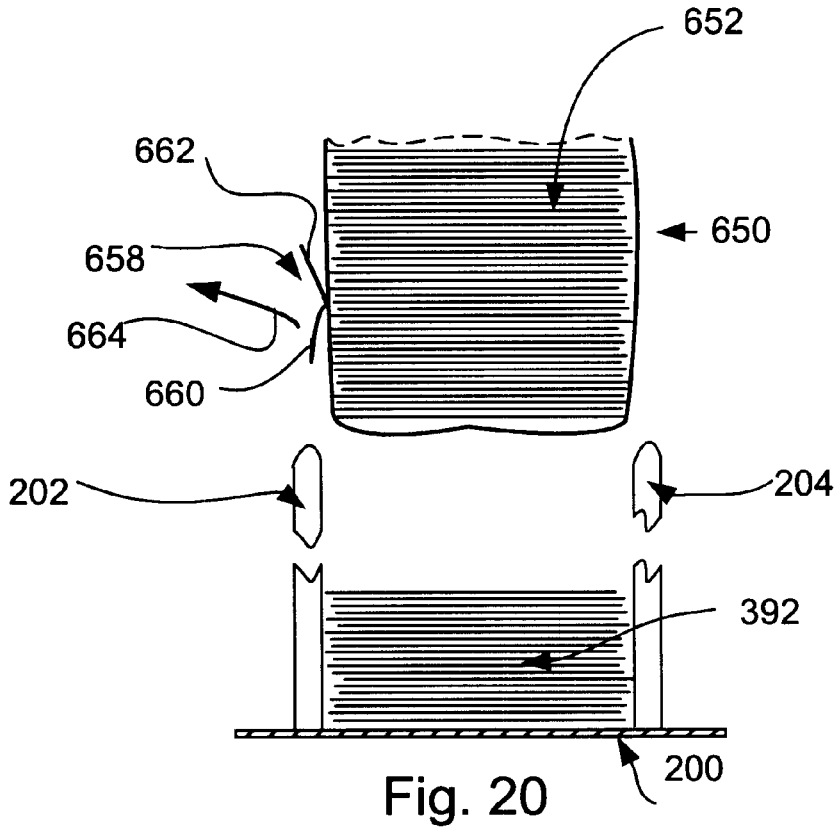
FIG. 20 is a schematic side view of a wrap for enclosing and dispensing envelopes into the feed station according to an embodiment of this invention.

Another embodiment for containing and dispensing a stack is shown in FIG. 20 using a surrounding flexible binding member 650 (the "container" of this embodiment) that secures the stack 652 together for storage and shipment. The binding member 650 can be one or more flat ribbons, joined at its normally free ends with adhesive or another mechanical joint system. Alternatively the binding member 650 can be or one or more string/cord ties secured at free ends with a knots or secondary joint members (clamps, twist-ties, etc.). The free ends of the binding member 650 are joined at a securing location 658 that is conveniently located for removal by the operator—such as along a stack side that is readily reached at the feed station. In general the free ends are joined by any mechanism that firmly secures the ends 660 and 662 together until release is desired. The release mechanism can involve a forcible movement to cause release, or even a cutting action using a blade.

To dispense, the stack is first located over the feed station. The tie ends are released from each other (arrow 664), enabling the overall binding member 650 to be removed from the stack 652. This usually occurs after the stack is loaded into the feed station along the guides so it does not lack side-support at any time. Because there is no separate side support provide by the container of this embodiment, the stack 652 is generally sized in depth no larger than the height of the guides 202 and 204—unless guide extensions are provided to enable a higher stack to be accommodated at the feed station 200. The binding member, in one or more pieces, can be easily slipped out from beneath the newly-deposited stack bottom after it is cut.

Figure 21:
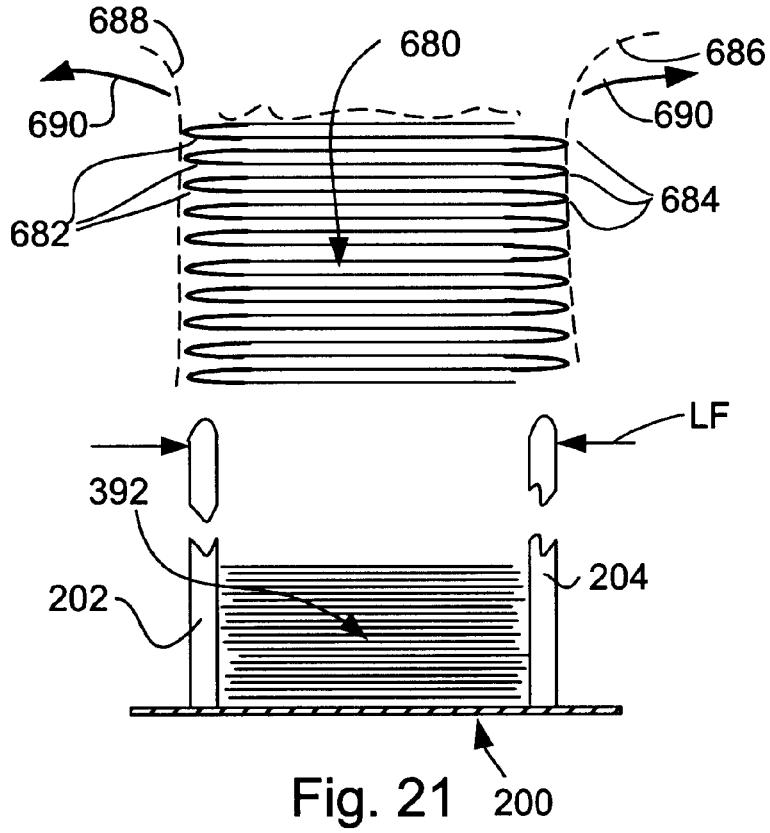
FIG. 21 is a schematic side view of a series of interconnections that contain and facilitate dispensing of the envelopes to the feed station according to an embodiment of this invention.

FIG. 21 illustrates yet another embodiment for containing and dispensing a stack of envelopes or other sheet-like materials. The stack 680 is joined together by a series of alternating, removable left tabs 682 and right tabs 684 that, in this embodiment, extend outwardly beyond the length LF of the feeder guides 202 and 204. The tabs 682 and 684 define folds at their ends and are joined to adjacent envelopes in the stack 680. A light removable adhesive can be applied to each of the tabs so that they pull easily from the envelopes to which they are joined using minimal tension. This adhesive can be similar in composition and performance to that available on popular self-adhesive memo/note pads that are commercially available. The tabs can be located so that they are positioned in the open space between guides. In this manner, they may project outward beyond the inner walls of the guides while the stack is deposited into the feed station. Tabs can be removed by a variety of techniques. For example, a pair of spines, shown generally by the dashed line elements 686 and 688, can be firmly joined to the folds of each tab. In one embodiment, these spines can be constructed from paper or plastic ribbon adhered to the folds of the tabs 682, 684 or can be strings/cords that are passed through perforated holes at each tab. In any case, the tabs are typically removed once the stack is deposited into the feed station 200 as depicted by arrows 690. Alternatively, the guides can be adapted to physically remove the tabs as the stack is driven down over the feed station. Appropriate mechanism for gathering, and disposing of, spent tabs are desirable in this example.

Figure 22:
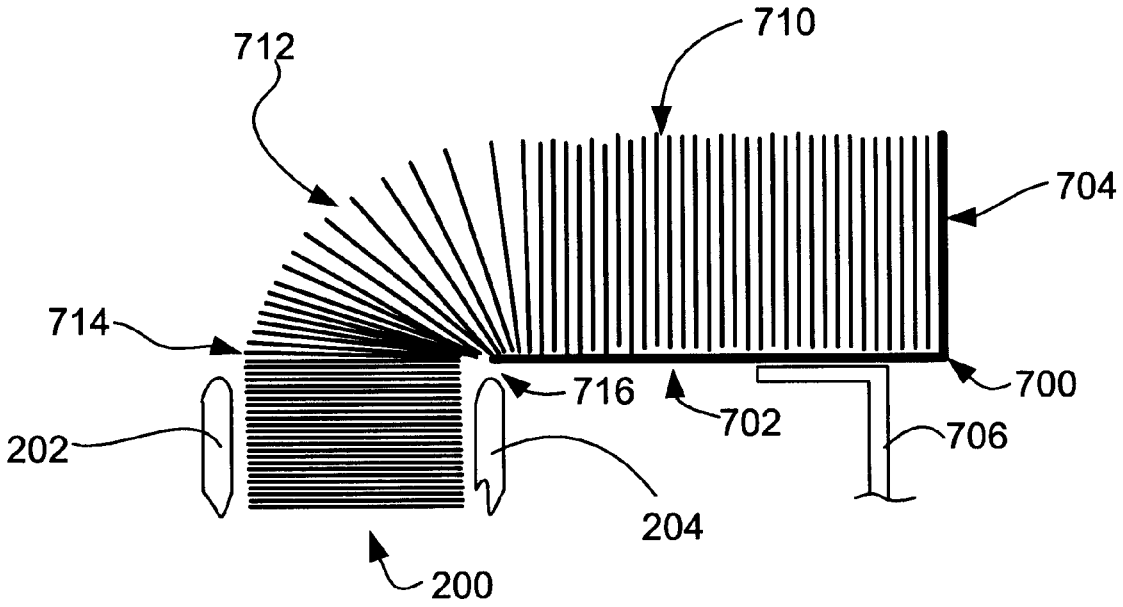
FIG. 22 is a schematic side view of an extended feed dispenser according to an embodiment of this invention.
Figure 23:
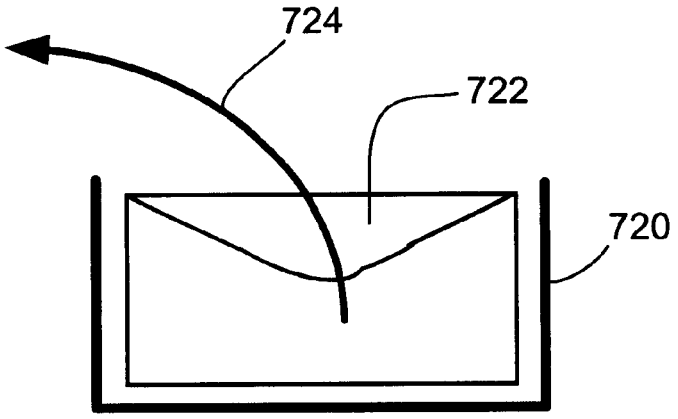
FIG. 23 is a schematic representation of the removal of bulk envelopes for transfer to the extended feed dispenser of FIG. 22.

Finally, FIG. 22 illustrates an alternate embodiment of the invention, in which a container structure 700 defining a bottom 702 and, an enclosed end 704 is provided adjacent the feed station 200. A secondary support 706 can be provided along the length of the bottom 702 to assist in supporting a container appropriately with respect to the feed station, or the container can include it's own internal support structure. Any acceptable bracket or support arrangement can be used to maintain the container 700 in place adjacent to the feed station. In fact, the container may be slightly canted downwardly toward the feed station in an alternate embodiment. A horizontal material/envelope stack 710 is located in the container. The stack is allowed to waterfall 712 into the primary feed stack 714 within the feed station through an open front end 716 of the container. The container 700 can be provided as a ready made unit with appropriate walls and guides, including a removable closure for the open front end 716 that enables the waterfall 712 to occur upon demand. Conversely, the container can be a fixed unit from which a large group of envelopes are deposited or carried from a separate storage container 720 as shown in FIG. 23. As such, the envelopes 722 in FIG. 23 are moved or otherwise transferred as a large group (arrow 724) out of the container 720 and onto the extended feed container 700.

Figure 24:
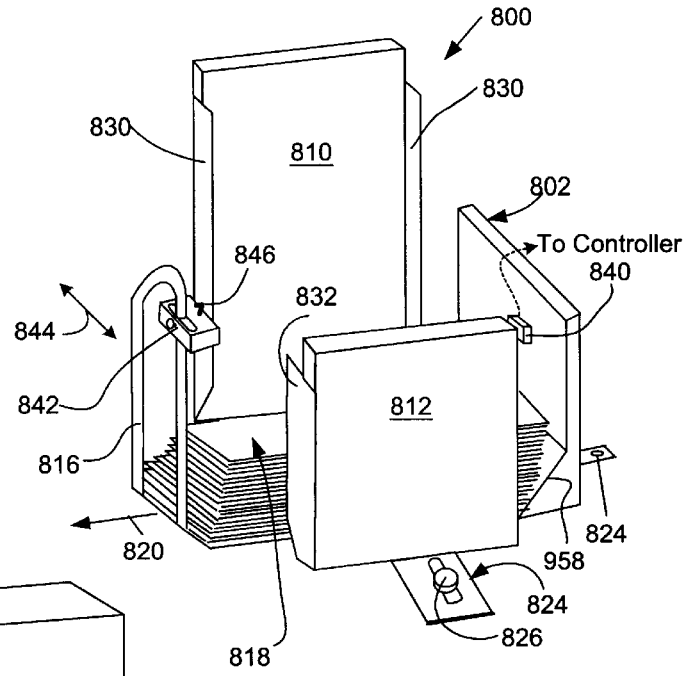
FIG. 24 is perspective view of a feed station receptor structure according to an illustrative embodiment of this invention.

FIG. 24 shows a feed station 800 for an envelope feeder or other sheet utilization device with a container or cassette receptor 802 according to an illustrative embodiment of this invention. The receptor 802 includes four upstanding walls 810, 812, 814, and 816 that generally define a rectangle. In this embodiment, the opposing walls 810 and 812 engage the elongated edges of the envelope stack 818, while the walls 814 and 816 engage the shorter side edges of the envelope stack. The wall 816 defines a U-shaped inverted metal bar that is adapted to enable the envelopes to pass thereunder in the direction of the arrow 820 to a feed location as described generally above.

The adjacent walls 810 and 816 in this embodiment are fixed so as to provide justifying locations for the envelopes so that they are aligned appropriately for entry into the downstream feed area of the utilization device. The walls 812 and 814 can be adjustable using appropriate adjustment members 824 that can include slides, cams or other locking mechanisms (such as the exemplary thumb screws 826 that interact with slots). In this manner, the walls 812 and 814 can be adjusted within a desired range of travel to accommodate varying sizes of envelopes or other sheet-like materials. The opposing walls 810 and 812 include, along their side edges, flexible strip members 830 and 832, respectively. These flexible strip members will be described further below. In general, they project approximately the width of the container plus about one-half the clearance of the envelopes with respect to the box. They are relatively thin (5 mils to ⅛ inch in one example) and are constructed from a variety of materials. Generally, a thin, flexible-yet-rigid material is used, such as a polyvinyl chloride (PVC), rubber or another elastomer. However, brush bristles, hinge members or another mechanism can be substituted. The strips are typically formed from a solid strip of material from top to bottom. However, they can be provided with comb-like slits that define a series of fingers according to an alternate embodiment.

The wall 812 includes a sensor 840 interconnected with a controller or other component, which can be used to detect the presence of a cassette within the receptor. This sensor can be optical, acoustic, capacitance, or any other acceptable sensing technology. The sensor can also define a bar-code reader, or a radio frequency identification mechanism, that detects a specific indicia on the cassette to determine, for example, its type, capacity, any preprint information, or other identifying information. The sensor is connected to a controller or other data gathering circuitry (a networked computer, for example—not shown).

On the adjacent wall 816, there is provided a block 842 that projects into the area of the envelope stack 818. The block 842 can be moved laterally along a slot (double arrow 844) to accommodate differently sized or located lips on cassettes—as will be described further below. A thumb screw or other lock mechanism can be used to adjust and fix the block in an appropriate position for receiving the selected cassette. Note that a variety of block structures and shapes can be used that are specific to particular patterns and/or sizes of cassettes. In addition, a projecting box opener 846 comprising, for example, a box-cutting blade can be provided to the block 842 for enabling a cassette loaded onto the receptor to be slit and spread, thereby facilitating easier passage of envelopes therefrom onto the stack 818.

Figure 25:
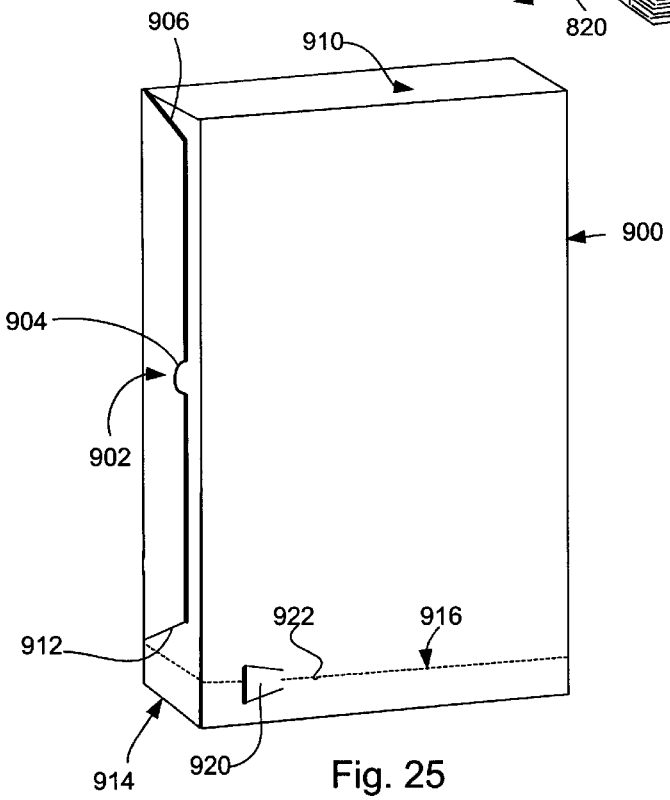
FIG. 25 is a perspective view of a container defining an envelope cassette for use with the receptor of FIG. 24.

FIG. 25 shows an exemplary cassette 900, according to an illustrative embodiment of this invention, adapted to mate with the receptor 802 shown in FIG. 24. It is expressly contemplated that the cassette 900 can be mated to alternate styles and types of receptors described above and otherwise contemplated by this invention. Similarly, the receptor 802 can receive a variety of cassette or container structures including those described herein and otherwise within the spirit and scope of this invention. The cassette 900 comprises a box structure generally constructed from cardboard or card stock (for example, corrugated cardboard), or a similar material having a sufficient wall thickness and strength to hold approximately 1,000 envelopes or other sheet-like materials. The internal structure of the cassette can be somewhat conventional in terms of its assembly and closure. For example, the edges can be folded and adhered or stapled together. Likewise, appropriate packing tape can be used.

Notably, the cassette 900 includes an overlapping flap 902 that, in this embodiment, is disposed on the outside of the box. However, it is contemplated that this edge can be placed inside the box in alternate embodiment. The flap 902 includes a finger cutout 904 that is optional. The flap 902 is tacked to the wall of the cassette so that it remains closed unless forcibly pried open. The tacking can be accomplished using intermittent glue spots, tape, staples or another suitable mechanism. The upper corner of the edge 906 is angled inwardly to prevent protrusion of the overlapping flap 902 beyond the top 910 of the cassette 900. The lower edge 912 is also angled inwardly. However, it is offset from the bottom portion 914 of the box to accommodate a bottom end opening mechanism 916. According to one embodiment, this mechanism consists of a pull tab 920 cut from the outer skin of the box, and adhered to a tear tape 922 (shown in phantom) of somewhat conventional design. The tear tape 922 in this embodiment comprises a sturdy piece of nylon strip or string that, when an outward pulling force is applied to the tab, causes the drawn tear tape to shear the cassette material so as to fully separate the bottom portion 914 along the tape line from the remaining upper portion of the cassette box.

Figure 26:
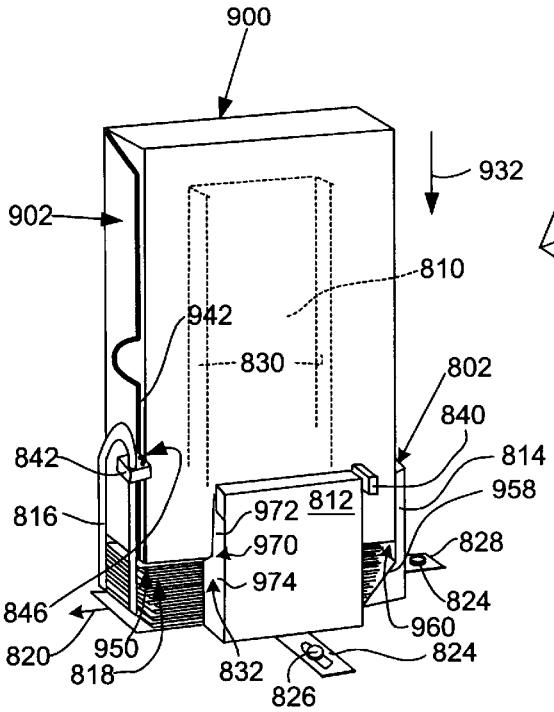
FIG. 26 is a perspective view of the receptor of FIG. 24 and cassette of FIG. 25 in engagement with each other.

As shown in FIG. 26, the cassette 900 is suspended over the receptor 802, having had its bottom portion 914 removed (arrow 930). The cassette 900 is, thus, lowered (arrow 930) onto the receptor so that it is engaged by the side walls 810, 812, 814, and 816.

As noted above, the cassette 900 is justified against the walls 810 and 816. The block 842 is set so that it bears against the raised edge 942 of the overlapping flap 902 of the cassette. In this manner, the block prevents the cassette from being inserted in any other orientation, thus ensuring that all envelopes are provided with the proper justification into the stack 818. Envelopes from the cassette are held in place by a finger or other retainer after the bottom portion 914 is removed, but before the cassette is placed fully into the receptor into communication with the top 950 of the preexisting envelope stack 818. Alternatively, a temporary retaining structure of a form described above or otherwise within the spirit and scope of this invention can be manually released or automatically actuated by an appropriate structure within the receptor 802 to cause envelopes to drop into the lower stack 818.

Note that the cassette 900 is suspended at a distance above the lower, preexisting stack 818 so as to not interfere with any output envelopes (note arrow 820) at the base of the stack. As the cassette 900 is lowered into the receptor, the cutter 846 may slit and spread the lower portion of the cassette at its point of contact with the cutter 846 to provide space for exiting envelopes, and to reduce friction generated by the cassette interior side walls.

Note also that the receptor wall 814 includes an angled lower edge 958. This angled edge is disposed at an angle of approximately 45 degrees to 85 degrees (but this is highly variable). The edge 958 engages the bottom edge 960 of the cassette when the cassette is lowered fully into position. The angle serves as a variable stop for the bottom edge 960 so that variations in the size of the cassette with respect to the receptor can be accommodate within a certain range while still suspending the cassette at a desired distance above the base of the stack 818. In addition, the edge helps to force the cassette into justification against the opposing fixed wall 816. As shown clearly by the bias of the strip 832 along the wall 812, a bend 970 is developed near the bottom edge 960 of the cassette. This bend transitions between an inwardly disposed portion 972 of the strip (adjacent the cassette side) and an unbent portion 974 of the strip (adjacent the lower stack 818). The strips 830 along the opposing wall 810 are also similarly bent. In this manner, the strips 830 and 832 firmly secure the cassette in place while it is mounted in the receptor, but enable the stack below the bottom edge 960 of the cassette to be properly justified by the outward edges of the strips 830 and 832. At the bend 970 a gradual transition is made that assists in guiding the envelopes into a properly justified position within the lower portion of the stack from their floating orientation between interior side walls of the cassette. As noted above, a more-abrupt transition can be generated if a series of fine slits are cut along the length of the strips to generate a comb-like structure. This arrangement may be desirable according to an alternate embodiment. Accordingly, the term "flexible strip" should be taken broadly to include any such structure that selectively bends to accommodate displacement by the cassette while remaining straightened at some location below (adjacent to the lower stack 818).

The receptor opposing receptor walls 810 and 812 are typically adjusted (moving wall 812 as appropriate) so that they firmly confront the outer faces of the cassette 900. These walls thus serve to firmly locate and justify the cassette along the axis therebetween, and correct any skew in the box structure by forcing the walls into line. The adjacent wall 814 and edge 858 further corrects skew in this manner. In general it is contemplated that at least two adjacent or opposing surfaces that apply normal forces to the walls of the cassette can be employed as a receptor according to this invention.

It should be clear that the receptor 802 functions without the presence of a cassette to feed a stack of a certain size, delimited by the height of the walls 810, 812, 814 and 816. Appropriate readjustment of one or more walls may be desired to better fit the stack without a cassette attached.

Figure 27:
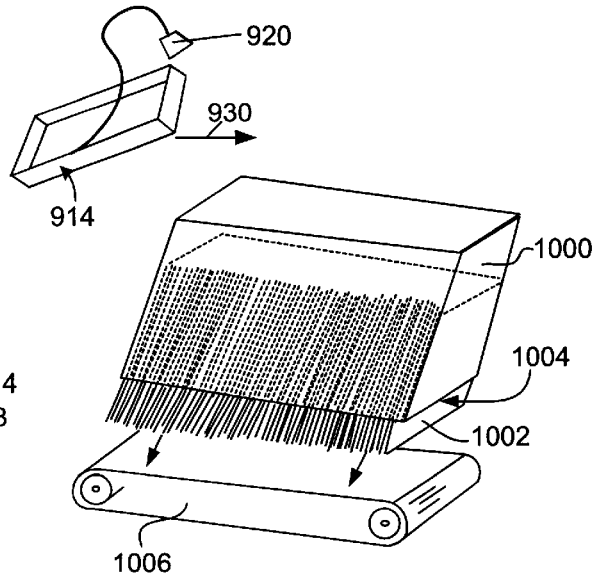
FIG. 27 is an exposed perspective view of an alternate embodiment of a container or cassette for dispensing envelopes or other sheet-like materials according to this invention.

Some further variations of the cassette structure and dispensing arrangement will now be described. FIG. 27 shows a cassette 1000 in which the envelopes or other sheet-like materials 1002 are dispensed from the cassette's bottom edge 1004 in an on-end configuration. In this embodiment at least a portion of the stack is dispensed to the feed station "simultaneously." This means that a group of envelopes/sheet-like materials is dispensed en masse to the appropriate site in the feed station. This can be desirable where a feeding arrangement such as shown in FIG. 22 is employed. The bottom edge 1004 can be open prior to loading (e.g. while still upright), so that dispensing occurs when the cassette is flipped over, or the bottom edge can be closed using a variety of closure/release methods and mechanisms described herein—including the tear tape of FIG. 25. It is noted that certain utilization devices employ an auto-load principal in which on-edge envelopes/sheet-like materials are deposited on a conveying structure 1006 so that they become shingled over one another once they are deposited. The cassette 1000 of this embodiment particularly facilitates batch-loading of such a device's conveyor. In particular, the Bell & Howell 4000 series employs such an auto-loader, and this cassette 1000 can be adapted specifically for use with such a device.

Figure 28:
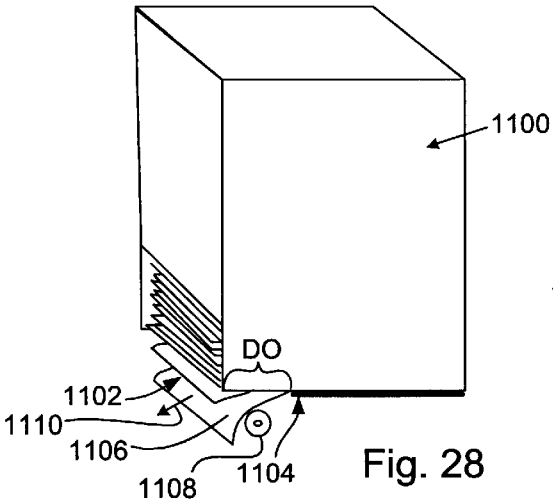
FIG. 28 is a perspective view of another alternate embodiment of a container or cassette for dispensing envelopes or other sheet-like materials according to this invention.

FIG. 28 shows another embodiment of a cassette 1100 in which envelopes or other sheet-like materials 1102 are dispensed from a partially opened bottom end 1104. The partial opening has a distance DO that is sufficient to enable the bottommost envelope/sheet-like material 1106 to engage a mechanical, vacuum or other extraction mechanism (for example, the wheel 1108) so as to move (arrow 1110) the bottommost envelope/sheet-like material out of the opening. The extraction technique can include direct sliding or a peeling-down motion (as shown), or any other motion that effectively removes the bottommost envelope/sheet-like material 1106 from the opening.

Figure 29:
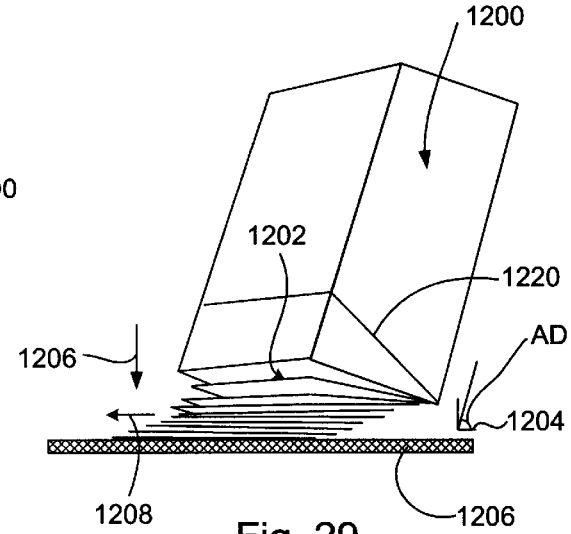
FIG. 29 is a perspective view of another alternate embodiment of a container or cassette for dispensing envelopes or other sheet-like materials according to this invention.

Finally, FIG. 29 shows a further variation of a dispensing technique for a basic box-like, open-bottomed cassette 1200. This cassette can be opened along its bottom edge 1202 using a variety of techniques described herein, and otherwise contemplated within the spirit and scope of this invention. This cassette 1200 is located at an angle AD that is non-perpendicular with respect to the plane 1204 of a feed surface 1206 (moving or stationary). In this manner, an angular opening is created with respect to the feed surface is by which envelopes are moved downwardly (arrow 1206) and outwardly 1208 away from the cassette's bottom edge opening in a more-efficient manner. This techinique assumes that singulating of envelopes or other sheet-like materials from the cassette occurs at a later time, downstream of the cassette 1200. Alternatively, the cassette can be placed perpendicularly so that the angle AD is, in fact, 90 degrees and an angled opening 1220 (shown in phantom) can be defined on the cassette bottom. The cassette 1200 can be provided with a separate tear tape or other mechanism (a perforation, for example) for selectively defining either a flat perpendicular bottom or angled bottom as shown. Alternatively, the cassette can have either a perpendicular bottom or angled bottom exclusively. All of the cassettes described herein can include the above-described overlapping side to enable random access to the entire length of the cassette for more-conventional access of the contents.

The foregoing has been a detailed description of numerous embodiments of the invention. Various other additions and improvements can be made without departing from the spirit and scope of this invention. For example, containers or other storage mechanisms described herein can include a variety of additional features for aiding in loading, unloading, stacking and storing of the materials therein. In particular, containers can include a variety of different flaps and covers that can be accessed for different purposes. One purpose can be to enable to container to be used as a conventional storage container in which envelopes or other sheet-materials are removed in small bundles by hand. This can include providing an elongated flap along one side of the container that can be opened to reveal the entire stack on edge. It is also expressly contemplated that a variety of different feed station elements can be provided to assist in the support and loading of containers, as well as the use of the feed station in a conventional manner in which individual bundles are transferred by hand. Significantly, the term "stack" should be taken broadly to include a variety of different groups of envelopes/sheet-like materials that are fed to a utilization device (including, but not limited to, edge-on groups, shingled feed arrangements, and the like). Finally, while the stack contents of various containers described herein are shown as released in their entirety in a single operation, it is expressly contemplated that less than the entire contents of a container can be dispensed at one time by the selective, controlled actuation of the container release mechanism. It is should be clear that the beneficial effects of this invention continue to be enjoyed even where less than the entire contents are dispensed, namely—minimal direct operator intervention, and more assurance of proper stack orientation. Accordingly, this description is meant to be taken only by way of example, and, not to otherwise limit the scope of this invention.

What is claimed is:

1. A system for storing and dispensing a supply of envelopes to a feeding device feeding envelopes from the bottom of a stack to a utilization device comprising:

A first container that is set onto the feeding device;

Wherein the first container is maintained in place for supplying the envelopes by gravity to the feeding device during a feeding operation;

Wherein the first container is replaced by a second container as the supply of envelopes in the first container is depleted;

Wherein the second container is maintained in place for supplying the envelopes by gravity to the feeding device during the feeding operation.

2. The system as set forth in claim 1 wherein the materials comprise envelopes having at least one flap.

3. The system as set forth in claim 2, wherein the feed station comprises an envelope inserter feed station having a plurality of upright guides for storing a stack of envelopes therein.

4. The system as set forth in claim 3 wherein the release comprises a shoulder structure at the dispensing opening that moves out of interfering contact with the stack of envelopes in the container when the shoulders are directed into engagement with the upright guides.

5. The system as set forth in claim 4 wherein the container includes four side walls defining a rectangular cross section and sized to surround an outer perimeter of the upright guides so that the container can be passed over the upright guides.

6. The system as set forth in claim 5 wherein the container includes a depth greater than a length of extension of the guides and wherein the container is constructed and arranged to support a portion of the stack therein after the container is passed over the guides while the stack is located at a position remote from upper most ends of the guides.

7. The system as set forth in claim 6 wherein the container includes a window adapted to reveal a portion of the materials so as to determine a level of materials in the container.

8. The system as set forth in claim 1, wherein the container comprises a comb having a spine and a series of projections that separate the materials, the comb being constructed and arranged to be withdrawn from the stack when the stack is located at the feed station.

9. The system as set forth in claim 1, wherein the container comprises a band that surrounds the stack, the band being constructed and arranged to be removed from the stack when the stack is located at the feed station.

10. The system as set forth in claim 1, wherein the container comprises adhesively joined members disposed between adjacent materials in the stack, the adhesively joined materials in the stack, wherein the container comprises adhesively joined members disposed between adjacent materials in the stack, the adhesively joined materials in the stack the adhesively joined members disposed between adjacent materials in the stack, the adhesively joined members being constructed and arranged to be withdrawn from the adjacent materials when the stack is located in the feed station.

11. The system as set forth in claim 1 wherein the dispensing opening of the container includes a plurality of interlocking closure flaps, each of the flaps having an overlapping tab section with respect to an adjacent one of the closure flaps so as to positively retain the stack against outward movement, but that are opened by applying a force in an opposing inward direction to unlock the interlocking closure flaps from each other.

12. The system as set forth in claim 1 wherein the container comprises a cassette having a flap that includes a raised external edge for accessing the stack through an opening other than the dispensing opening.

13. The system as set forth in claim 1 wherein the feed station includes a plurality of upright walls defining a receptor for receiving the cassette thereinto, at least one of the walls including a block that confronts the raised edge so as to restrict receipt of the cassette to a predetermined orientation with respect to the receptor.

14. The system as set forth in claim 13 wherein the receptor includes a sensor for detecting information with respect to the cassette.

15. The system as set forth in claim 1 wherein the feed station includes a plurality of upright walls, at least some of the walls including a flexible strip that bends adjacent to the cassette and that remains extended and unbent along at least a portion of the feed station remote from the dispensing opening.

16. The system as set forth in claim 15 wherein at least one of the walls includes an angled lower edge that is adapted to bias the cassette into an opposing wall so as to justify the cassette with respect to the feed station.

17. The system as set forth in claim 16 wherein at least one of the walls includes an adjustment mechanism for changing a spacing of the one of the walls respect to another of the walls.

18. The system as set forth in claim 1 wherein the container comprises a cassette and the stack release comprises a tear strip located adjacent to an end portion of the cassette and adapted to separate the end portion from a remainder of the cassette.

19. The system as set forth in claim 1 wherein the feed station includes a conveying surface and the container comprises a cassette adapted to dispense a plurality of the materials of the stack simultaneously to the conveying surface from the cassette.

* * * * *